US008713984B2

(12) United States Patent
Wilson, Jr.

(10) Patent No.: US 8,713,984 B2
(45) Date of Patent: May 6, 2014

(54) MULTIPLE MODE, BI-DIRECTIONAL UNIVERSAL BENDING APPARATUS

(76) Inventor: David Wilson, Jr., Fort Collins, CO (US)

( * ) Notice: Subject to any disclaimer, the term of this patent is extended or adjusted under 35 U.S.C. 154(b) by 561 days.

(21) Appl. No.: 13/005,897

(22) Filed: Jan. 13, 2011

(65) Prior Publication Data

US 2012/0180545 A1 Jul. 19, 2012

(51) Int. Cl.
*B21J 9/18* (2006.01)

(52) U.S. Cl.
USPC ..... 72/449

(58) Field of Classification Search
USPC ..... 72/449, 482.8, 380, 381, 384, 386; 74/413, 414; 475/149
See application file for complete search history.

(56) References Cited

U.S. PATENT DOCUMENTS 346,371 A 7/1886 Humphrey
682,347 A 9/1901 Sims
682,671 A 9/1901 Condon
1,052,069 A 2/1913 Lassiter
1,079,442 A 11/1913 Rutledge
1,118,046 A 11/1914 Poffinbarger
2,939,432 A 6/1960 Birdsall
3,236,082 A 2/1966 Beck et al.
3,447,353 A 6/1969 Noveske
3,680,347 A 8/1972 Schenck et al.
3,991,600 A 11/1976 Del Fabro
4,025,224 A 5/1977 Starbard
4,080,787 A 3/1978 Biggs, Jr. et al.
4,485,650 A 12/1984 Yamamoto et al.
4,986,104 A 1/1991 Caporusso et al.
6,013,004 A 1/2000 Gage et al.
7,293,362 B2 11/2007 Konen
2008/0190164 A1 8/2008 Boon et al.

*Primary Examiner* — Debra Sullivan
(74) *Attorney, Agent, or Firm* — David G. Oberdick; Peter J. Borghetti

(57) ABSTRACT

Apparatus and methods for use of synchronized plural epicyclical transmissions to stabilize and to drive an output gear of a machine capable of bending tubing, conduit, and pipe requiring high torque, as well as swaging, cutting, and threading. One embodiment of the apparatus includes multiple transmissions encircling and engaged with a centrally mounted motor. Another embodiment of the apparatus includes multiple transmissions, each engaged with a mounted motor. Transmissions can be equidistantly spaced around the perimeter of an output gear.

18 Claims, 27 Drawing Sheets

X – 12 o'clock
Y – 4 o'clock
Z – 8 o'clock

MULTIPLE MODE, BI-DIRECTIONAL UNIVERSAL BENDING APPARATUS

FIELD OF THE INVENTION

The present invention relates to an apparatus and methods for plural transmissions for rotation of a single output gear, and more particularly, relates to an apparatus and methods for bending tubing, conduit, and pipe requiring high torque.

BACKGROUND OF THE INVENTION

Depending on the application, many different bending geometries may be required. For instance electricians often bend conduit at a 90 degree angle to turn a corner while installing wiring in a commercial building, or make large sweeping nested bends to stack a successive series of bends with decreasing radius to enclose and shield electrical wiring.

Principally there are three primary methods of bending a piece of tubing with conventional bending equipment: rotary compression where a set of follower wheels pressures the tubing around a mandrel; rotary draw where the end of the tubing is captured by a lug on the bending mandrel, pulled around the circumference of the mandrel, and incremental bending where the tubing is advanced in increments of an inch and bent from 2 to 10 degrees per incremental advance. Incremental bending is useful for bending diameters much larger than the mandrel size provided on the bender and useful for bending large arches found in green houses, or making race track-like nested tubing arrays found in commercial electrical contracting. Incremental bends are currently accomplished with large hydraulic benders. To date all commercial benders capable of bending conduit, pipe, and tubing require a minimum of 110 volts AC, thereby requiring the tool to be plugged into a hot power source to supply the necessary voltage for AC motors from 1 to 5 horse power depending on the machine. This makes common bender useless where no power source is available.

SUMMARY OF THE INVENTION

The present invention provides a universal bending machine capable of rotary compression, rotary draw, or mechanized automatic incremental advance bending. In rotary draw bending, a bending mandrel locks to the end of the tubing and the mandrel rotates pulling the tubing through a shoe or roller to bend the tubing. Rotary compression benders use a follower block to push the tubing around a mandrel. Sweeps are a form of incremental bending, which are carried out with large hydraulic equipment. Additional features useful to a pipe fitter are provided such as tube facing, cutting, and threading. The present invention weighs approximately 70 lbs, which makes it easy to transport, inexpensive to ship, and convenient to lock up in on site tool boxes. The present invention is easily adapted to computers to command and monitor bending programs (Bendtech) for each of the three bending styles supported with the use of simple pulse width modulation and simple programs. Alternatively, the machine is easily wired for manual operation with a common switch. A series of basic attachments allow the present invention to surface and prepare the end of tubing for swaging, welding, and threading.

The present invention supports all three bending methods in both clockwise and counterclockwise travel. The present invention provides apparatus and methods for high efficiency development and transfer of high radial torque loads for bending pipe. High efficiency torque transfer enable the apparatus's size weight and cost maintained to a minimum combined with the added utility of operation on rechargeable batteries or simple electrical transformers. The present invention is compact and powerful producing torque outputs values in excess of machines weighing 5 times the size. A multiple transmission driven center output drive disk and projecting center pin are key to enabling both rotary compression and rotary draw bending in combination with movable and repositional reaction platforms. The present invention requires low power input to produce high torque output. The bending apparatus comprises interconnecting components made of light weight, high strength that are easily manufactured and assembled to form a compact, light weight, highly reliable and efficient tubing bender. Tubing materials include, but are not limited to, stainless steel, aluminum, copper, brass, iron, titanium. The present invention is adaptable to perform many functions other than bending tubing including, but not limited to swaging.

One embodiment of the present invention includes a rotatable platform having diametrically opposed socket receivers with spring load pins (not shown) for rapid attachment or removal of interchangeable forming wheels and pipe forming roller fitted arm to rotate bending attachments. Centrally mounted drive gear is secured in a housing and mounted for rotation with axle and bearing support. The axle stationary axle is secured to back face of the apparatus with an enlarged flange is secured with threaded fasteners to provide a ridged mounting utility for output mandrels and attachments. The axle extends from the back surface and extends through the tool projecting to a position beyond the front face of the apparatus and is secured against rotation. The axle projects from the center of the back face of the apparatus's housing aligns, positions and supports the output gear in driven engagement for rotation with three drive gears extending from individual planetary transmissions secured to the back face of the machine. The axle serves as a ridged mounting location for interchangeable tube forming mandrels.

One embodiment of the present invention includes a bending apparatus having a plurality of motors (for example, air motors or electric motors) in which the motors are mounted to a housing such that an output shaft of the air motors are positioned at a radial location from the axis of rotation of an output drive disk that is less than the radius of the output drive disk. Use of air motors to drive the present invention provides a simple way of providing an intrinsically safe bender useful in highly flammable environments.

Another embodiment of the present invention includes a plurality of transmissions driven by a single centralized motor driven planetary gear box. The central motor and transmission drives satellite transmission disposed around the perimeter of an output gear. Reduces the number of transmissions required by 2 planetary stages when compared with the use of three motor driven planetary stacks. Single motor drive allows the speed reduction and torque multiplication of the three stacks to be affected and controlled by shifting the transmission.

For a better understanding of the present invention, together with other and further objects thereof, reference is made to the accompanying drawings and detailed description.

BRIEF DESCRIPTION OF THE DRAWINGS

The present invention is illustratively shown and described in reference to the accompanying drawings, in which.

DETAILED DESCRIPTION OF THE INVENTION

Figure 1:
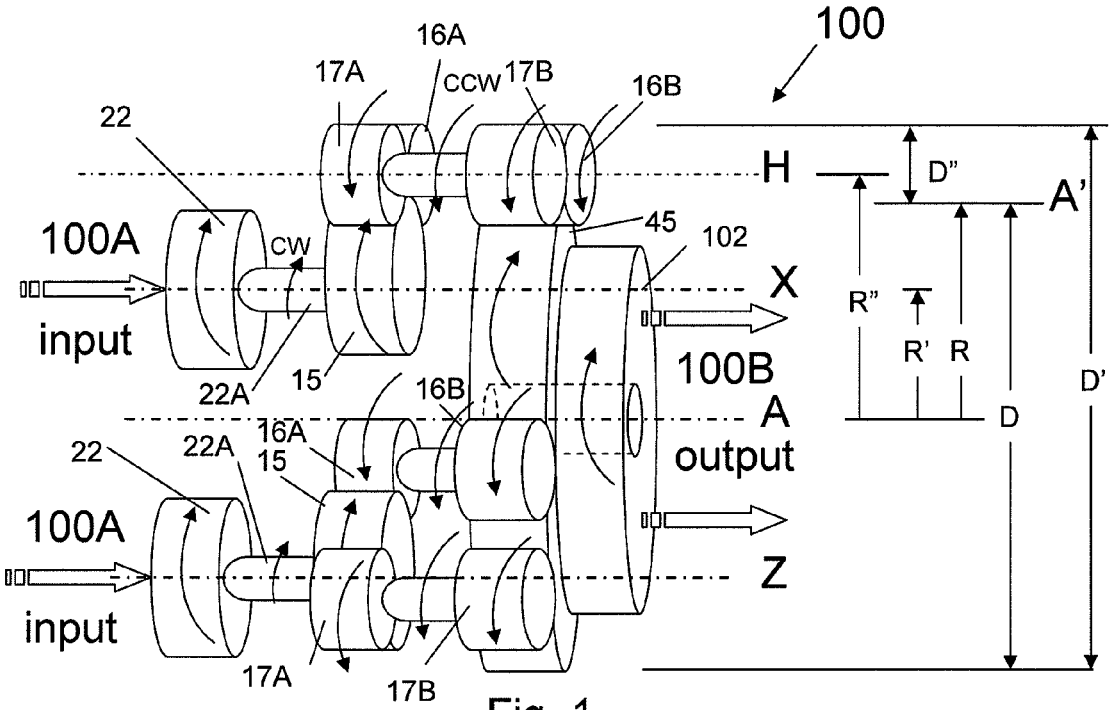
FIG. 1 is a pictorial representation of one embodiment of the present invention showing relative rotational movements of interconnected rotating components and relative radial/diametrical dimensions.
Figure 2:
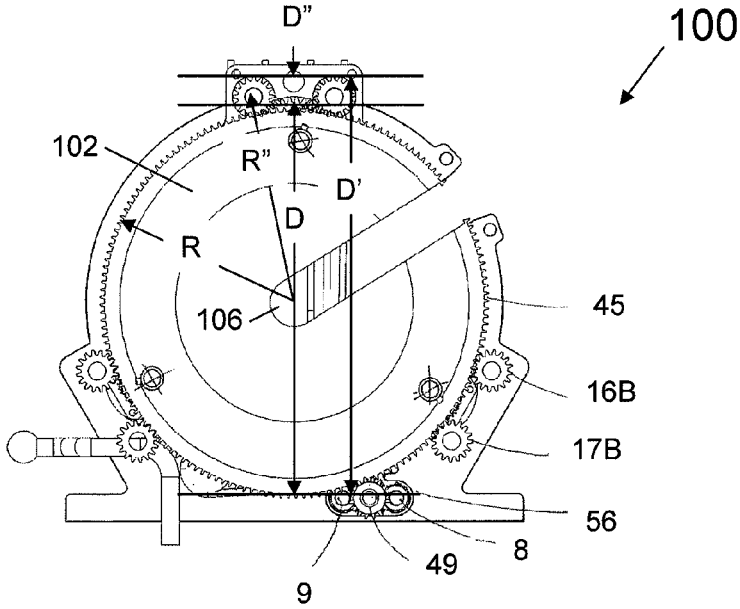
FIG. 2 is a front view of the embodiment of FIG. 1.

One aspect of the present invention is illustrated in FIGS. 1 and 2 as a bending apparatus 100 showing relative rotational movements and radial/diametrical orientation of interconnected rotating components driving output drive disk 45 along outer geared circumference 45A having radius R of output drive disk 45. Power input 100A is provided by one or more motors 22 coupled to first (drive) gear 15 that meshes with second (idler) gears 16A, 17A, which are coupled to third (idler) gears 16B, 17B, which mesh with output drive disk 45 to transmit output power 100B through front face 102 to a desired functional attachment tool 300 (FIG. 3), such as a tube bender or swagger, instead of transmitting torque through a shaft disposed along the axis of rotation A of output drive disk 45. Motor 22 will be illustrated herein as an air motor, however, it is contemplated that any other suitable motor (such as an electric motor) is acceptable. Air motor 22 is bi-directional capable of rotating output drive disk 45 clockwise (shown in FIG. 1) and counter-clockwise about a common axis of rotation A. FIG. 2 shows a front view of output drive disk 45 illustrating idler gears 16B, 17B and proximal timing gear 49, which is linked to a timing mechanism connected to a pneumatic controller to control direction and or stop one or more air motors 22 discussed in detail below. A tool can be connected to output drive disk 45 having universal tool adapter receiving holes 104A, 104B (FIG. 3) to adapt bending apparatus 100 to any application, such as tube bending and swaging. The embodiment illustrated herein is a tube bender; however, it will be appreciated that bending apparatus 100 can be adapted for any function that requires mono- or bi-directional rotational actuation.

The air motors 22 are connected to gears meshed 16B, 17B to the geared outer circumference of a single output drive disk 45 that transmits rotational power to a tool attached to the front face of the single output drive disk 45 to eliminate the need for a common shaft that extends through the center line A of the single output drive disk 45. Larger idler gears 15 are located between the air motors 22 and the idler gears 16B, 17B meshed with the output drive disk 45 and have an axis of rotation X same as the air motor 22. The idler gears meshed 16B, 17B with the output drive disk 45 are positioned at a radius R from the axis of rotation A of the output drive disk 45 greater than the radius R' of the air motor 22 and larger idler gear 15. The arrangement of idler gears 16, 17 in series allows the planetary transmission to be mounted to the inside footprint of the bending apparatus 100 instead of the outside foot print due to the inboard positioning of the air motors 22. This allows the entire layout to be several inches more compact in all directions.

Now turning to FIGS. 5-9, the present invention utilizes a plurality of synchronized transmissions 21 to supply torque to drive a large output drive disk 45. The use of multiple transmissions 21 allows for the use of small light weight motors 22 and gears 325, 327 with higher diametric pitch and narrow face widths than would ever be possible with a single point of gears in mesh. Unique transmission configurations allow the present invention to provide exceptionally large torque values required for bending heavy wall pipe in a light weight, compact super structure operating at a high level of mechanical efficiency allowing the machine to operate on rechargeable batteries in remote areas. The center shaft 317 (also referred to as a first tool) of the present invention is never directly driven, the drive mechanisms 16B, 17B are directly engaged in multiple positions along the perimeter of the large output drive disk 45 (See FIG. 2).

Now turning to FIG. 1, each air motor 22 includes a shaft 22A with axes of rotation either being X, Y (FIG. 7), and Z. The axes of rotation X, Y, Z of air motor shafts 22A are oriented at substantially the same radial distance R' from the common axis of rotation A such that radial distance R' is less than radius R of output drive disk 45. The diametrical stack D' (D"−D=D', where D equals diameter of output drive disk, D" equals a distance from geared outer circumference 45A of output drive disk 45 to outer circumference of idler gear 16B, 17B) is maintained at a minimum. Each air motor 22 can be positioned at substantially equal angular distance, for example 120°, from an adjacent air motor 22 and being positioned in proximity of the outer circumference 45A of the output drive disk 45 at radial distance R'. This arrangement allows for the efficient transmission of torque from the plurality of air motor drive units 20 to outer circumference 45A of output drive disk 45.

Now turning to FIGS. 2, 5, 7, and 12 further illustrating bending apparatus 100 including a housing with back chassis plate 24, middle chassis plate 19, a front chassis plate 18, and front chassis plate 18. The plurality of air motors 22 are mounted in parallel orientation to back chassis plate 24 and middle chassis plate 19. Output drive disk 45 is disposed between middle chassis plate 19 and front chassis plate 18 and retained by second (idler) gear 16B, 17B without a hub support fixture (e.g. shaft and bearing journal) connected to center aperture 106 to align output drive disk 45 about the common axis of rotation A. Front housing plate 18 includes a center opening 18A to externally expose front surface 102 of output drive disk 45. Main housing 310 includes front face 110 with two apertures 109 to receive an extension 303C of object holder 303, which is one of the attachments to facilitate holding an object for performing an operation.

Now turning to FIGS. 3, 4, 10A, 10B, 11, and 12 for an example of tooling for an operation. For illustration purposes, a tube will be the object to hold. Tube holder 302 is connected to object holder 303 to form a single component. Tube holder 302 can be connected before or after object holder 303 is inserted into either the left or the right aperture 109 for bending counter-clockwise or clockwise tube bending respectively. Tube holder 302 and object holder 303 cooperate with third tool 304 (such as forming die) to retain an object (such as a tube) while second tool 308 (such as a bender arm) rotates during an operation (e.g. bending, swaging) on the object.

Figure 3:
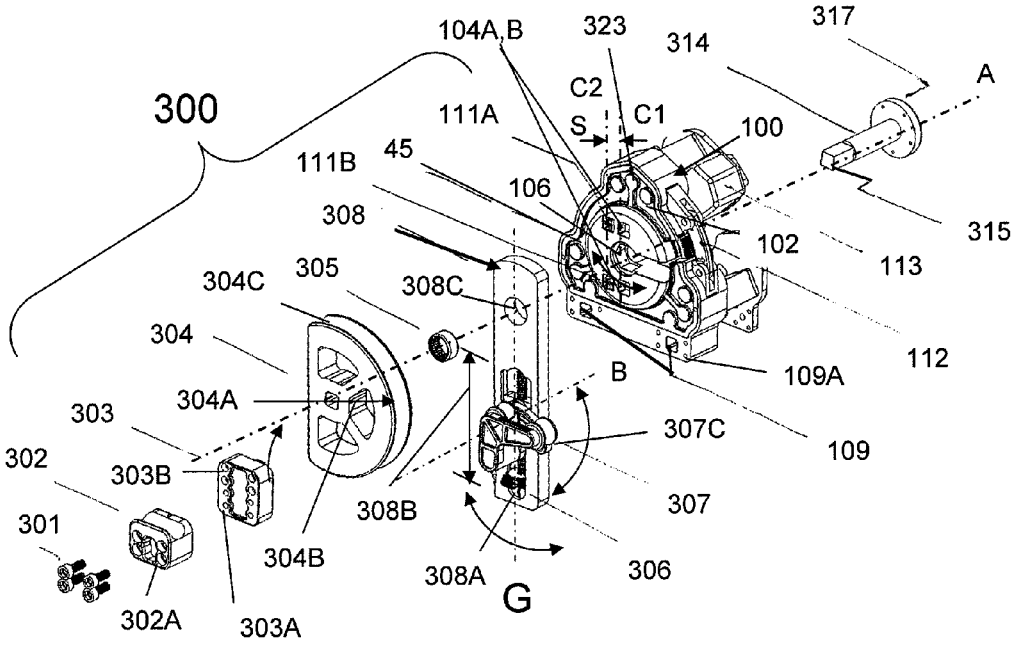
FIG. 3 is an exploded view of one embodiment of a tool assembly for use with the present invention.
Figure 4:
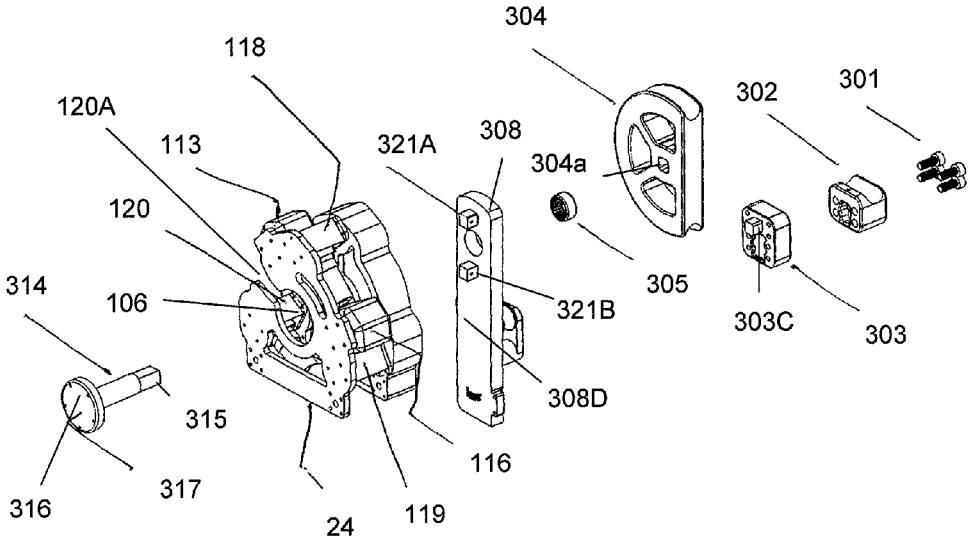
FIG. 4 is a reverse image of the exploded view in FIG. 3.
Figure 12:
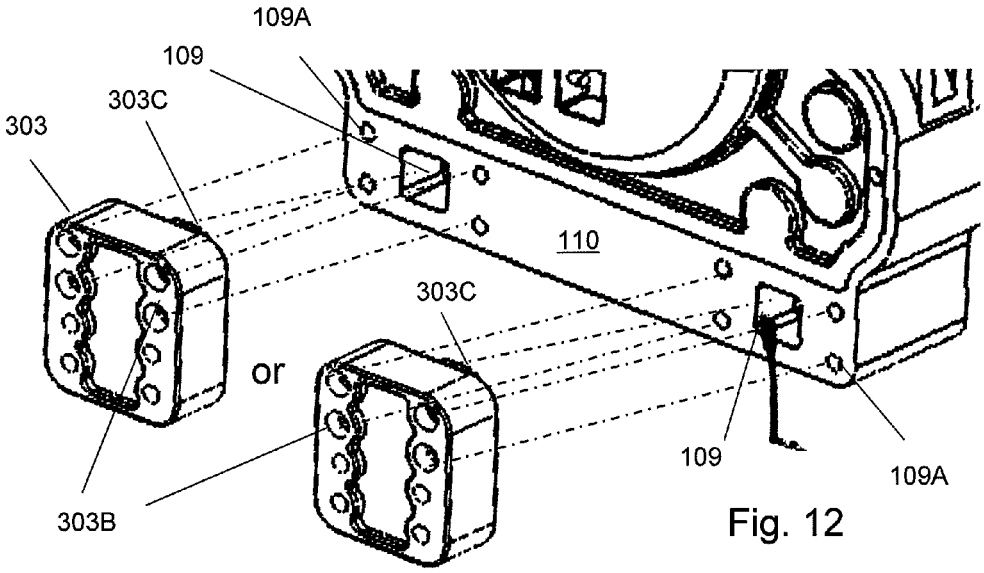
FIG. 12 is a magnified perspective view of one embodiment of the front face of the present invention illustrating the tube holder optional positioning on the left or right side of the front face of the bending apparatus for bi-directional tube bending.

Now turning to FIGS. 2-4 illustrating further features of bending apparatus 100 that cooperate with tool attachment 300 to accomplish a desired task, such as bending a tube. As discussed above, one embodiment of output drive disk 45 of the present invention includes a center aperture 106 sized to freely receive there through a first tool 317 (such as a forming die connector). Front face 102 includes universal tool adapter receivers 104A, 104B, for example square holes, to secure a plurality of lug connectors 321A, 321B on rear surface 308D of second tool 308 such that second tool 308 is secured to output drive disk 45 and rotates with output drive disk 45 while first tool 317 and third tool 304 are stationary. First tool 317 can be attached to back chassis plate 24 and cantilevered through center aperture 106 of output drive disk 45 such that first tool 317 does not contact center aperture 106 or interfere with the rotation of output drive disk 45. First tool 317 includes elongated shaft 314 with back plate 316 attached to back chassis plate 24 and an end 315 that extends out beyond front face 102 of output drive disk 45 to statically connect third tool 304 to bending apparatus 100. Shaft end 315 can be a square geometry, as shown in FIG. 4, to be freely received by square hole 304A for ease of assembly and disassembly of the two components. An alternative embodiment of the connection feature can be a tight fit or inference fit such that first tool 317 and third tool 304 are not easily separated.

As mentioned above, one embodiment of the present invention is tube bender tool 300 illustrated in FIGS. 3, 4, 10A, 10B, 11, and 12 that can include four tools: first tool—forming die connector 317, second tool—bender arm 308; third tool—forming die 304, and fourth tool—holding block 302/object block 303. Static components of tube bender tool 300 can be connected to back chassis plate 24 and front connection holes 109, for example square pockets, on front face 110 of main housing 310. Forming die 304 is statically attached to bending apparatus 100 by forming die connector 317 having shaft 314 and end 315 that pass through center hole 120 of bending apparatus 100. Bearing housing 305 seated in rotary arm bearing hole 308C of bender arm 308 allows shaft 314 to be securely retained by bearings 305A while bender arm 308 freely rotates about axis A without torsion loading to shaft 314 of static tool connector 317. Shaft end 315 can be non-circular geometry, such as a square-shaped geometry shown in FIGS. 3 and 4, to loosely fit within hole 304A of forming die 304 for easy installation and removal. An alternative embodiment can include a tight fit or interference fit between shaft end 315 and hole 304A. Forming die 304 can have any desired bend radius 304B depending on user's needs. A tube can rest in tube recess 302B of tube holder 302. Tube holder 302 is attached to bending apparatus 100 by connecting tube holder 302 with bolts 301 through holes 302A of tube holder 302 to lower holes 303A of object block 303. Object block 303 also includes connector 303C that is received into either the left side or the right side square pockets 109. Object block 303 can be secured to bending apparatus 100 with bolts (not shown) through upper holes 303B and into holes 109A on front face of front chassis plate 18.

As discussed above, bender arm 308 can be connected to output drive disk 45 with universal adaptor receiving holes 104A sized to receive lug connectors 321A, 321B (FIG. 4) of bender arm 308 such that bender arm 308 rotates in unison with output drive disk 45 about axis A. Universal adaptor receiving holes 104A are positioned in plane C1 aligned with the diameter of output drive disk 45 and rotationally oriented about axis A. A second set of pivot arm receiving holes 111A, 111B positioned in plane C2 aligned with a segment of the output drive disk 45, such that plane C2 does not pass through rotational axis A of output drive disk 45 about. Planes C1 and C2 are off-set a distance S, which results in different bend radius. Adaptor receiving holes 104A, B are universal connectors for all applications of bending apparatus 100. Wheel block 307 can be pivotally attached to bender arm 308 to independently pivot about axis B, which is perpendicular with axis A. Bender arm 308 can include a mechanical longitudinal adjustment 306 to position wheel block 307 along axis G within slot 308A having length 308B. Wheels 307C mounted to wheel holding blocks 307 follow the tubing and force the tubing to form around the circumference 304C of the forming die 304. Back surface 308D of bender arm 308 utilizes square lugs connectors 321A, 321B plugged into square pockets 109 on front face 110 of main housing 310 to secure the bender arm 308 to output drive disk 45.

Figures 10A, 10B:
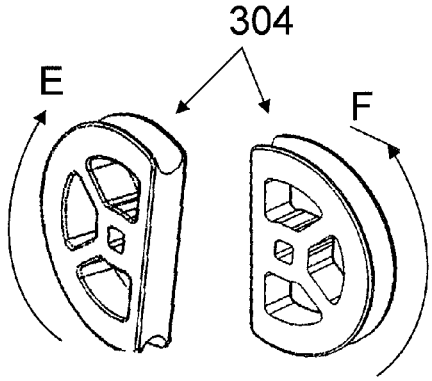
FIG. 10A is a pictorial illustration of reversible forming die for bending tubing in direction E (clockwise)
FIG. 10B is a pictorial illustration of reversible forming die for bending tubing in direction F (counter-clockwise)
Figure 11:
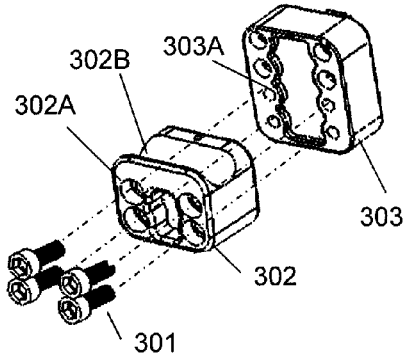
FIG. 11 is an exploded views of one embodiment of a tube holder for one embodiment of the present invention.

As mentioned above, bending apparatus 100 is bi-directional and provides the flexibility to bend tubing clockwise or counter clockwise. Forming die 304 is reversible, as shown in FIGS. 10A and 10B, and wheel block 307 can be rotated about axis B for either clockwise or counter clockwise actuation.

Now returning to FIGS. 3 and 4 illustrating pivot bracket 112 being pivotally attached to bending apparatus 100 to allow access through center hole slot 120A to feed a tube into center hole 120 of bending apparatus 100 for bending, swaging, and cutting. Also illustrated in FIG. 4 are gear boxes 118, 119 and drive unit motor housings 113, 116 that are discussed in detail below.

Figure 5:
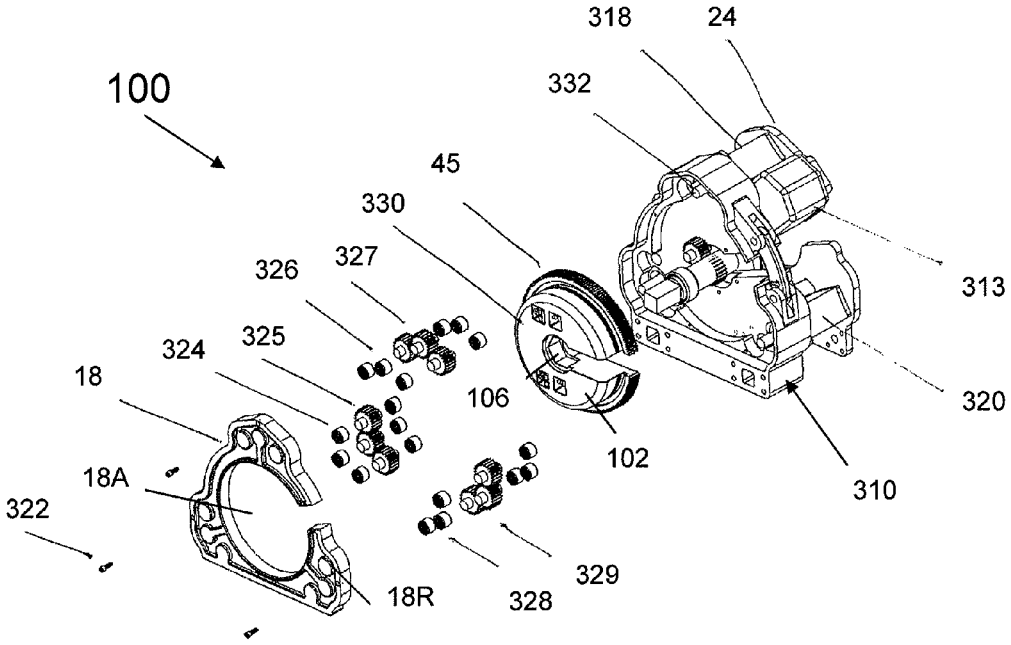
FIG. 5 is an exploded view of the idler gears that drive the output drive disk of one embodiment of the present invention.
Figure 6:
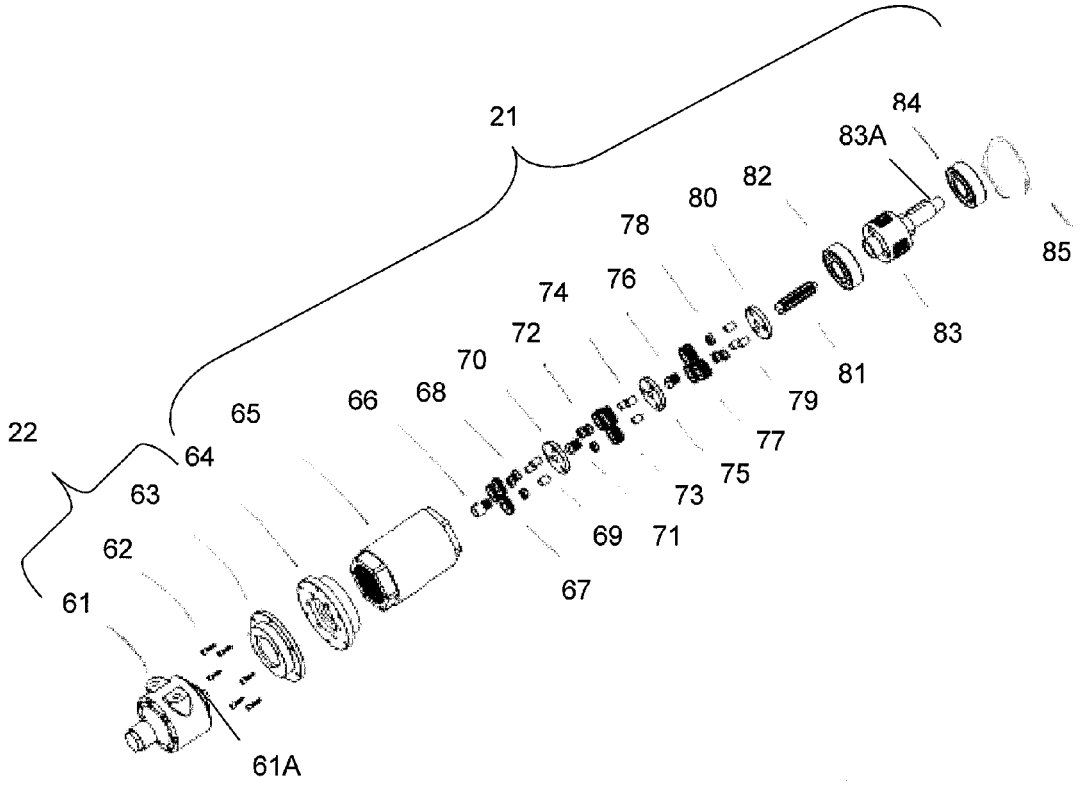
FIG. 6 is an exploded view of one embodiment of air motor and planetary cylinder assemblies.
Figure 7:
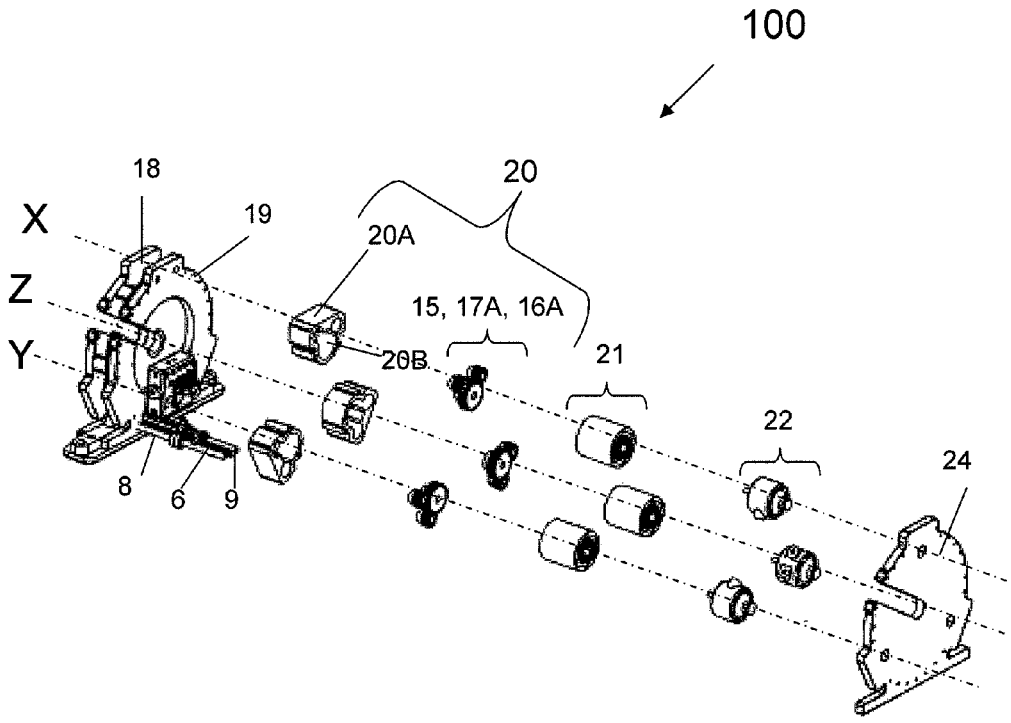
FIG. 7 is an exploded view of one embodiment of the drive mechanism of the present invention illustrating the orientation of three (3) air motors.
Figure 8:
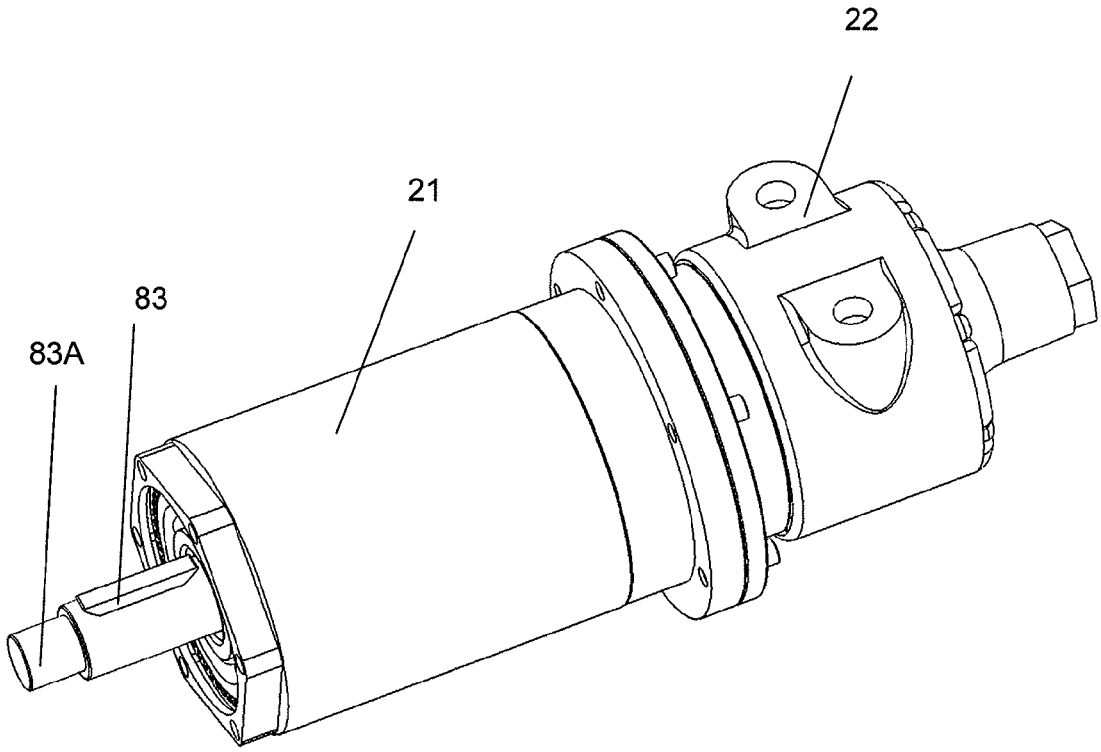
FIG. 8 is a perspective view of connected air motor and planetary cylinder assemblies.
Figure 9:
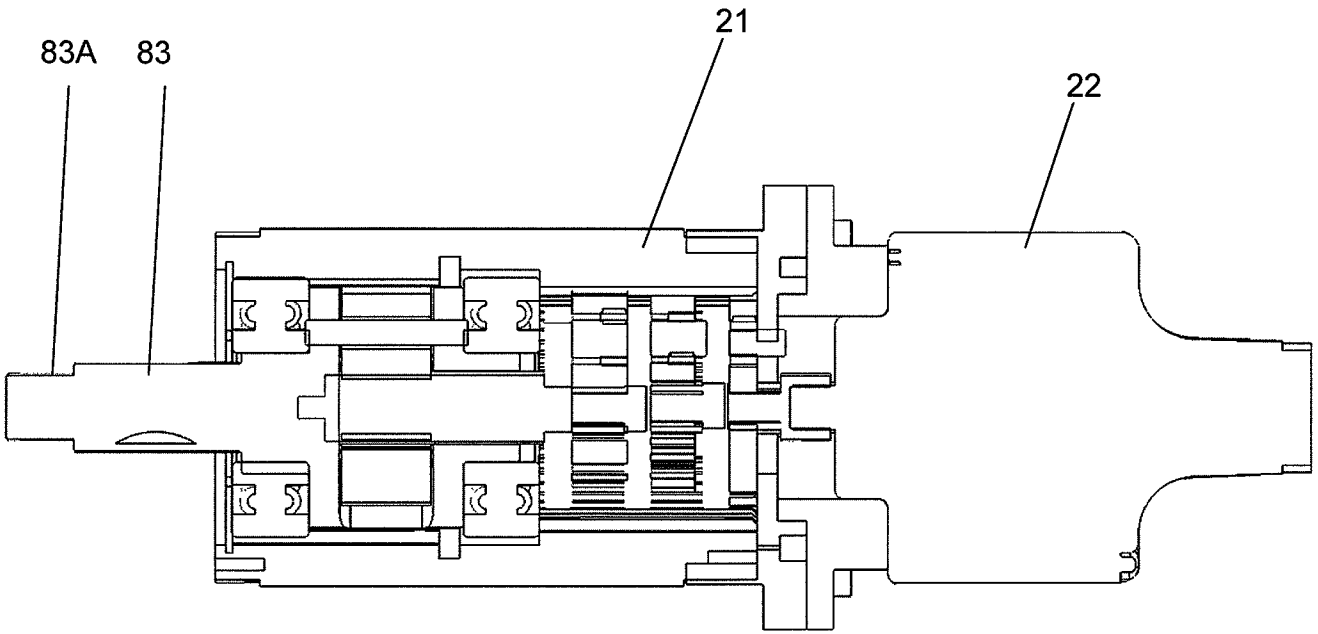
FIG. 9 is a cross-sectional view of air motor and planetary cylinder assemblies of FIG. 8 illustrating the interconnecting components.

Now turning to FIGS. 2, 5, 6, 7, 8, and 9 that illustrate bending apparatus 100 gear mechanism that operably connects air motor 22 to output drive disk 45. Air motor 22 rotatably connects to planetary cylinder assembly 21 that rotationally connects with first (drive) gear 15, which meshes with second (idler) gears 16A, 17A to rotate counter-part third (idler) gears 16B, 17B to drive output drive disk 45. As discussed above, output drive disk 45 has attachment features, such as adapter receiving holes 104A, 104B, to adapt bending apparatus 100 to any application, such as tube bender and swagger. The 4-stage planetary cylinder and mount 20 houses first (drive) gear 15 and third (idler) gears 16B, 17B. FIG. 7 shows housings for 4-stage planetary cylinder 20, planetary cylinder 21, and air motor assembly 22 are shown for the 12 o'clock position (X), 4 o'clock position (Y), and 8 o'clock position (Z). The 4-stage planetary gear housing 20A can include recess 20B configured to receive meshed first (drive) gear 15 and second (idler) gears 16A, 17A. First (drive) gear 15 and third (idler) gears 16A, 17A result in a 1869 to 1 ratio (7×7×7×5.45).

Now turning to FIG. 6 that illustrates embodiment of assemblies of air motor 22 and planetary cylinder 21. A commercially available air motor 61 is mounted to planetary mount plate 64 utilizing motor mount plate 63 and screws 62. Planetary mount plate 64 is connected to planetary gear barrel 65 housing the rotating components of the planetary cylinder 21 listed in order of connectivity: stage 1 sun gear 66, stage 1 planetary gears 24 DP 67, stage 1 bearings 68, stage 1 axle 69, planet spider 70, stage 2 sun gear 71, stage 2 planetary bearings 72, stage 2 planetary gears 73, stage 2 planetary gear axles 74, stage 2 planetary gear spider plate 75, stage 3 sun gear 76, stage 3 planetary gears 77, stage 3 planetary gear bearings 78, Stage 3 planetary gear axle 79, stage 3 planetary gear spider plate 80, shaft 81, planetary gear spider cage and gear top bearing 82, planetary gear spider cages and stage 4 gears 83, planet gear spider cage lower bearing 84, and lower bearing retainer "C" clip 85. Motor shaft 61A rotatably connects to sun gear 66 of planetary gear assembly 21 and torque is rotationally transmitted through the above mentioned rotating components of the planetary gear assembly 21 to end 83A of planetary gear spider cage and stage 4 gears 83 to drive gear 15. End 83A is received into bearings 324, 326, 328 disposed in recesses 18R in front chassis 18 (See FIG. 5), thereby operably connecting motor 22 to front chassis 18. End 83A is rotatably supported by front chassis 18 and is not cantilevered. With ends 83A of planetary gear assembly 21 supported, the weight of output drive disk 45 can be carried by drive gears 325, 327, 329 and load transmitted to front chassis 18, middle chassis 19, and back chassis 24 and without the need of a center hub support through output drive disk center hole 106 for the weight of output drive disk 45 to rest on and transmitted through.

Now turning to FIG. 5 illustrate an exploded view of the gear drive system of bending apparatus 100 including screws 322, front chassis plate 18 with center opening 18A, bearing 324 disposed between front chassis plate 18 and 8 o'clock drive gears 325 that drive output drive disk 45, bearing 326 disposed between front chassis plate 18 and 12 o'clock drive gears 327 that drive output drive disk 45, bearing 328 disposed between front chassis plate 18 and 4 o'clock drive gears 329 that drive output drive disk 45, output drive disk center hole 106, front face 102 of output drive disk 45, air motor coupling 332, air motor housing 320, back chassis plate 24, gear housing 313, and air motor housing 318.

Figure 13:
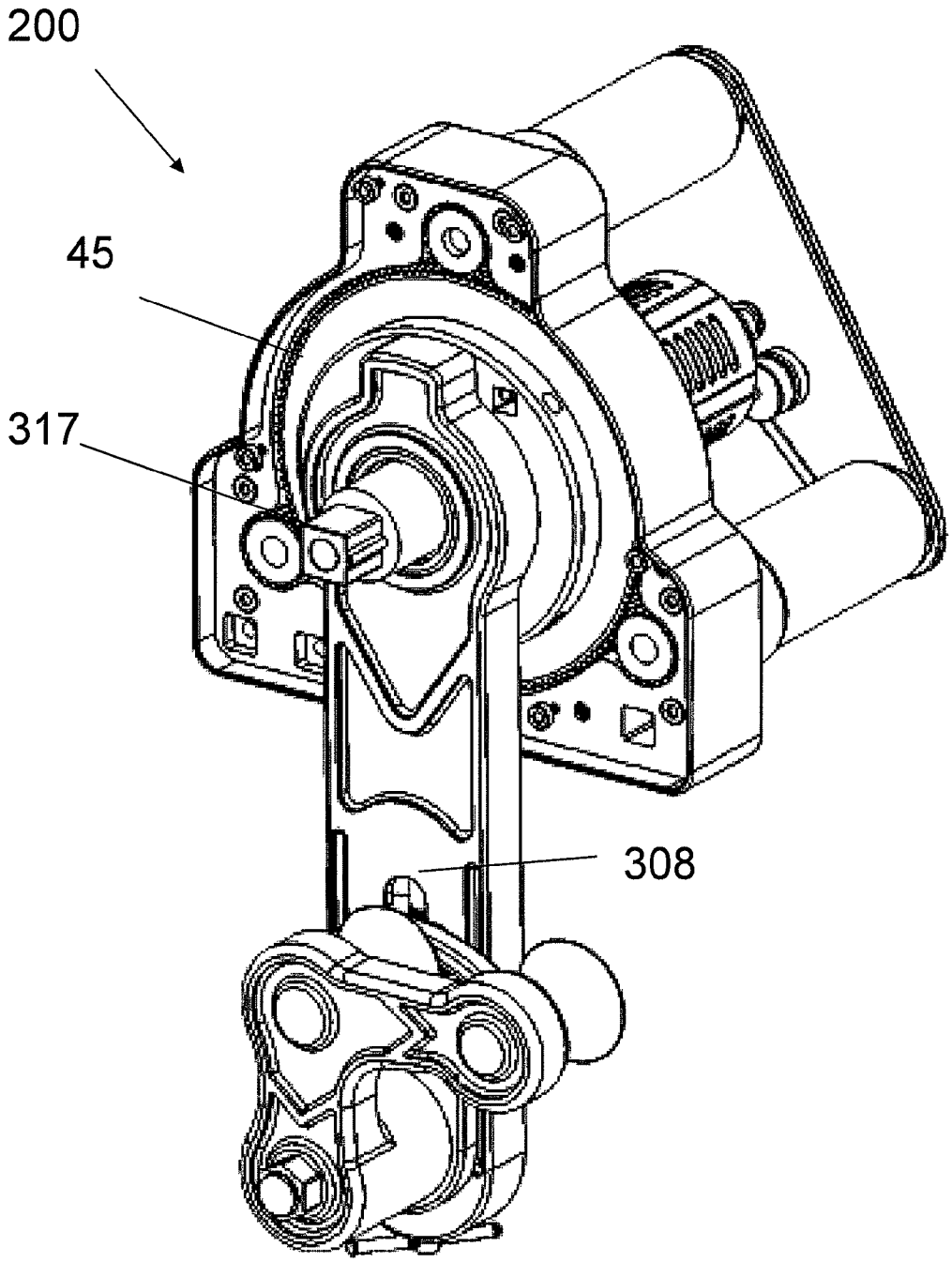
FIG. 13 is a front perspective view of the embodiment of FIG. 1 with its complete housing and back plate without the front chassis plate and the bending mandrel attached.
Figure 14:
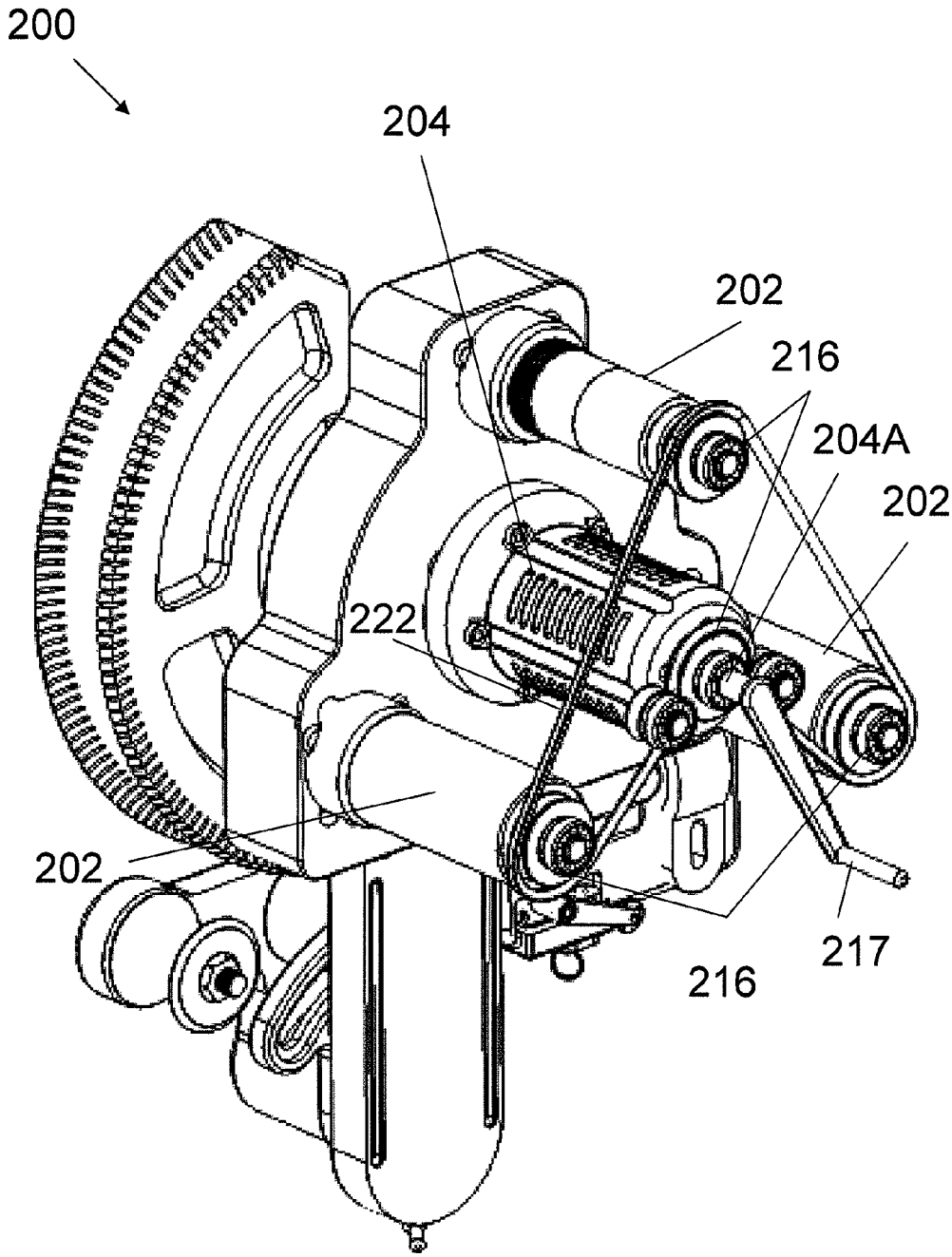
FIG. 14 is a rear perspective view of another embodiment of the present invention with a single center drive motor engaged by a belt to three equi-distant multiple-stage stacked epicyclical geared transmissions.

Now turning to FIG. 13 that illustrates a completely assembled bending apparatus 100 with an on-board computer. Apparatus 100 is shown without the bending mandrel 304 and front chassis plate 18 to show outer drive disk 45 gear engagement and bender arm 308.

FIGS. 14-23 illustrate another embodiment 200 of the present invention includes a plurality of transmissions driven 202 by a single centralized motor 204 driven planetary gear box. The features of embodiment 200 are the same as embodiment 100 unless otherwise noted herein. The central motor 204 and transmission drives satellite transmission 202 disposed around the perimeter of an output gear 206 (See FIG. 20). This configuration reduces the number of transmissions required by (2) planetary stages when compared with the use of three motor driven planetary stacks disclosed above. Single motor drive 204 allows the speed reduction and torque multiplication of the three stacks to be affected and controlled by shifting the transmission on the center or sun motor and transmission package. One exemplary embodiment 200 includes a housing 206, cover 208, king pin 210, mandrel 226, output gear 212, plurality of satellite gears 214, plurality of multi stage stacked epicyclical geared transmission 202, commercially available two speed torque adjustable center mounted gear box 204 drive pulleys 216, belt 222 that engages all pulleys 216, bearing and an end plate 218, with entry ports and attachment points for batteries, computer 220, switch, coupler for attachment to a wheeled transformer enable stand. Hand crank 217 can be attached to drive shaft 204A.

Figure 16:
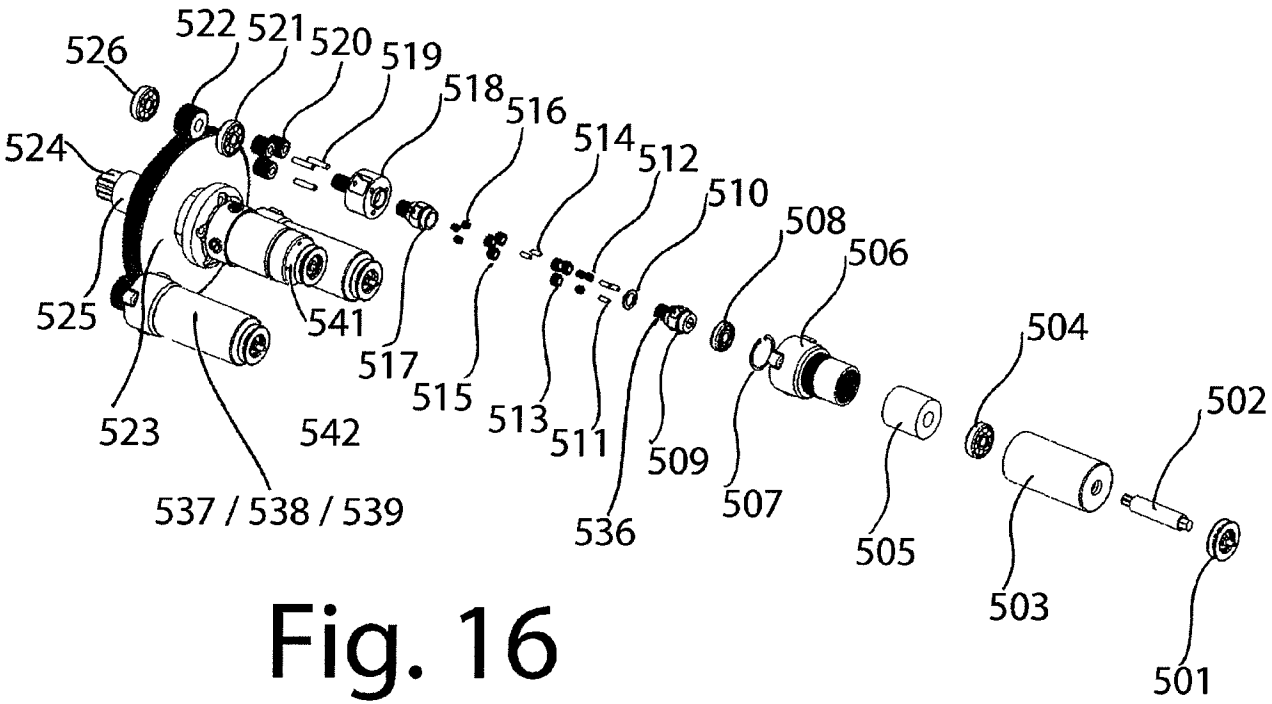
FIG. 16 is a exploded rear view of a multiple-stage stacked epicyclical geared transmission.
Figure 17:
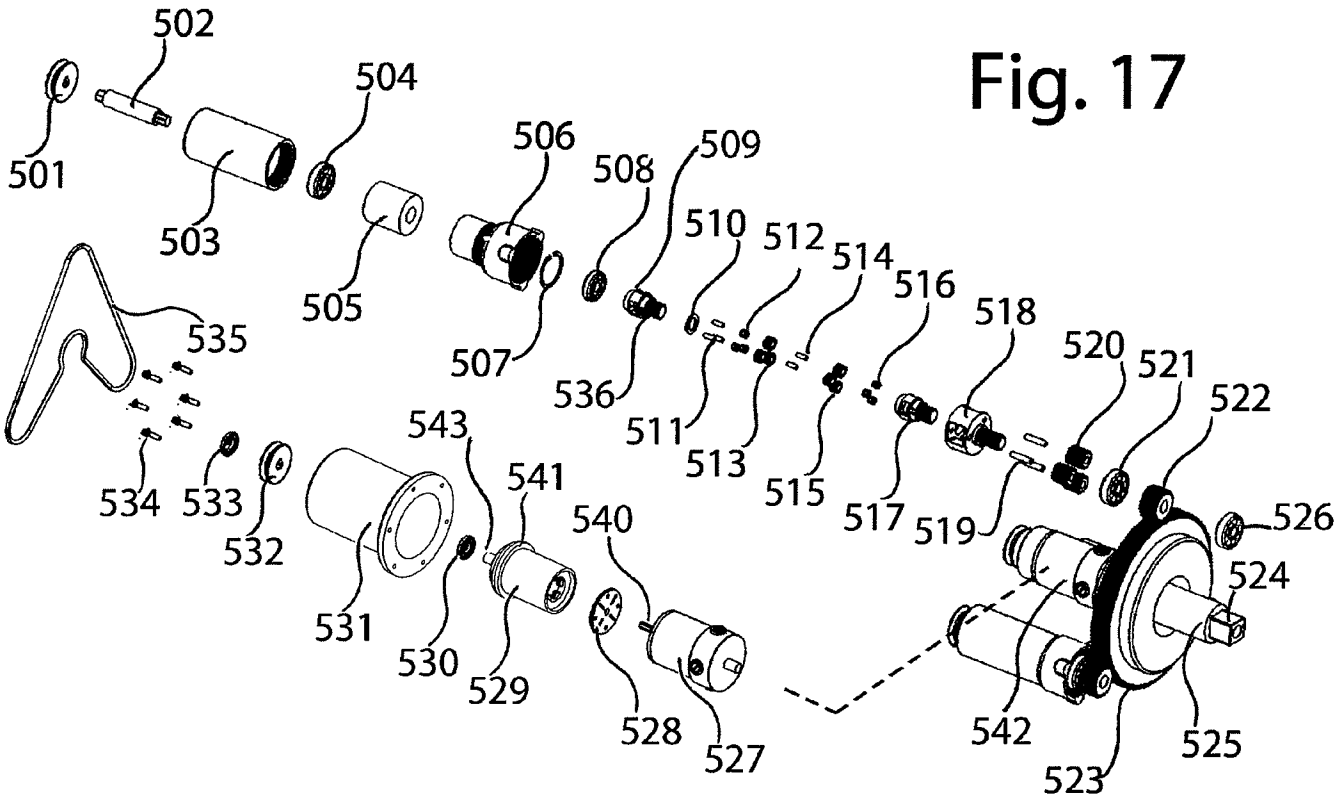
FIG. 17 is a exploded front view of a multiple-stage stacked epicyclical geared transmission.
Figure 18:
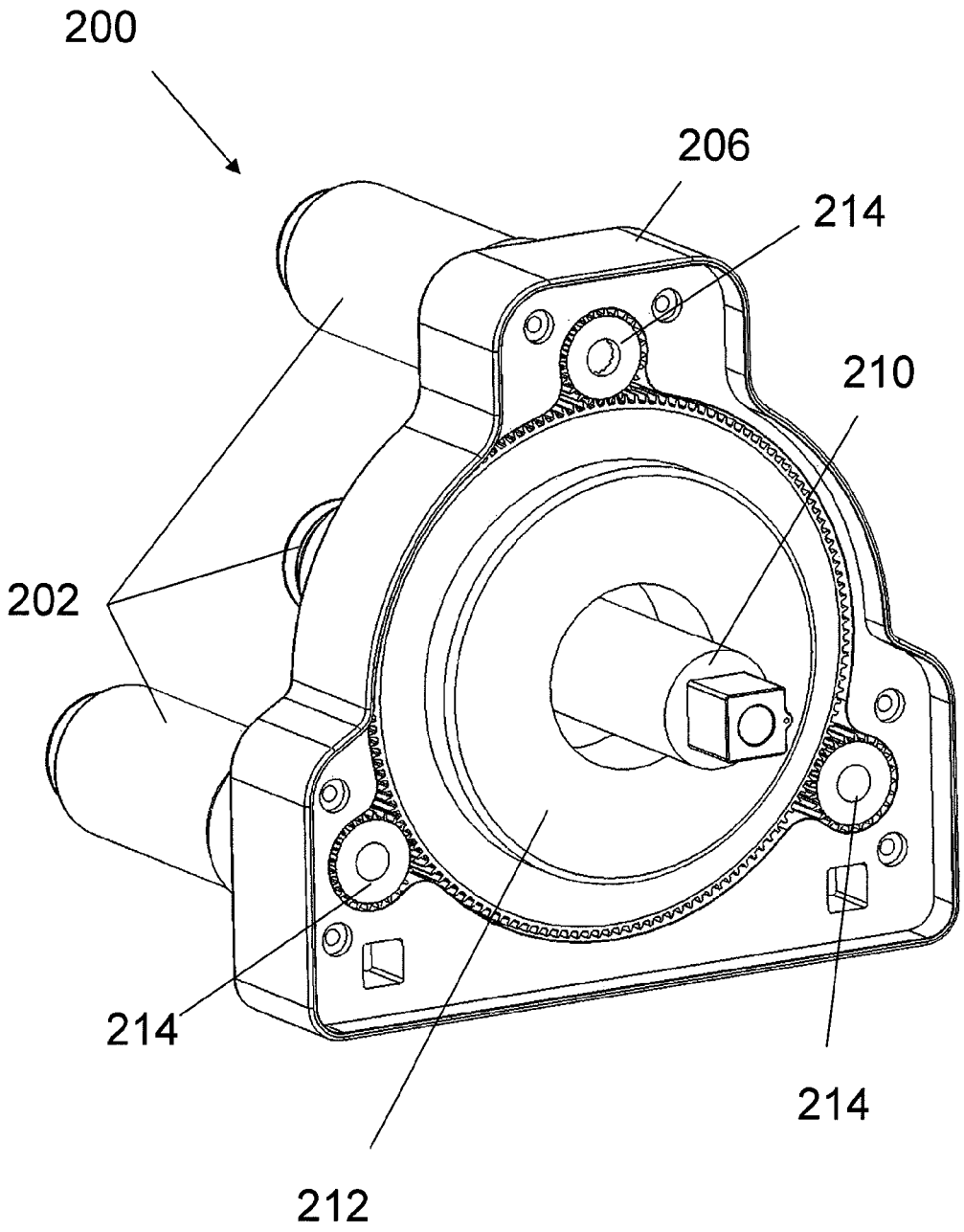
FIG. 18 is perspective view of the embodiment of the present invention of FIG. 14 without the front chassis plate and the bending mandrel attached.
Figure 19:
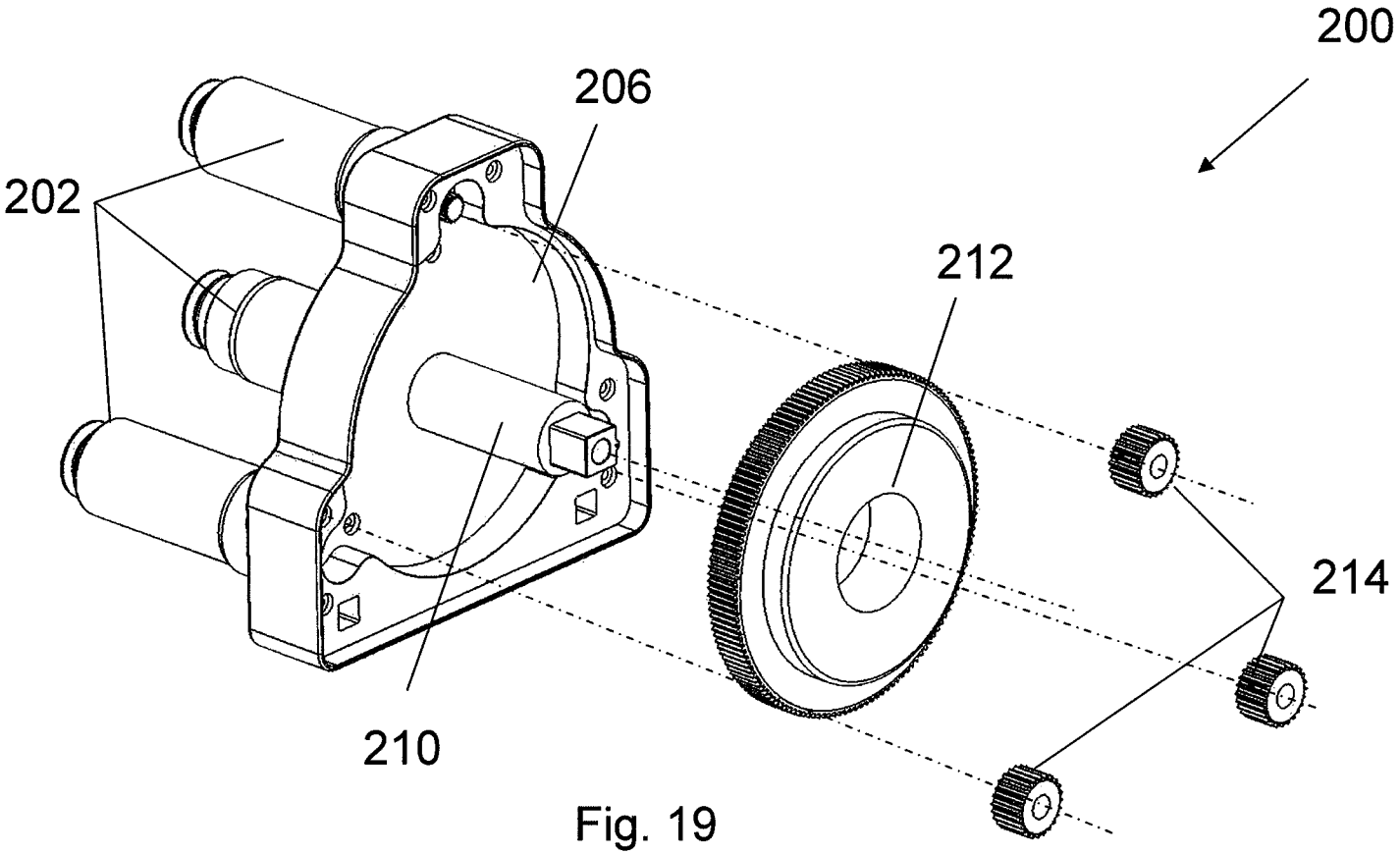
FIG. 19 is a exploded view of the embodiment of the present invention shown in FIG. 18.
Figure 20:
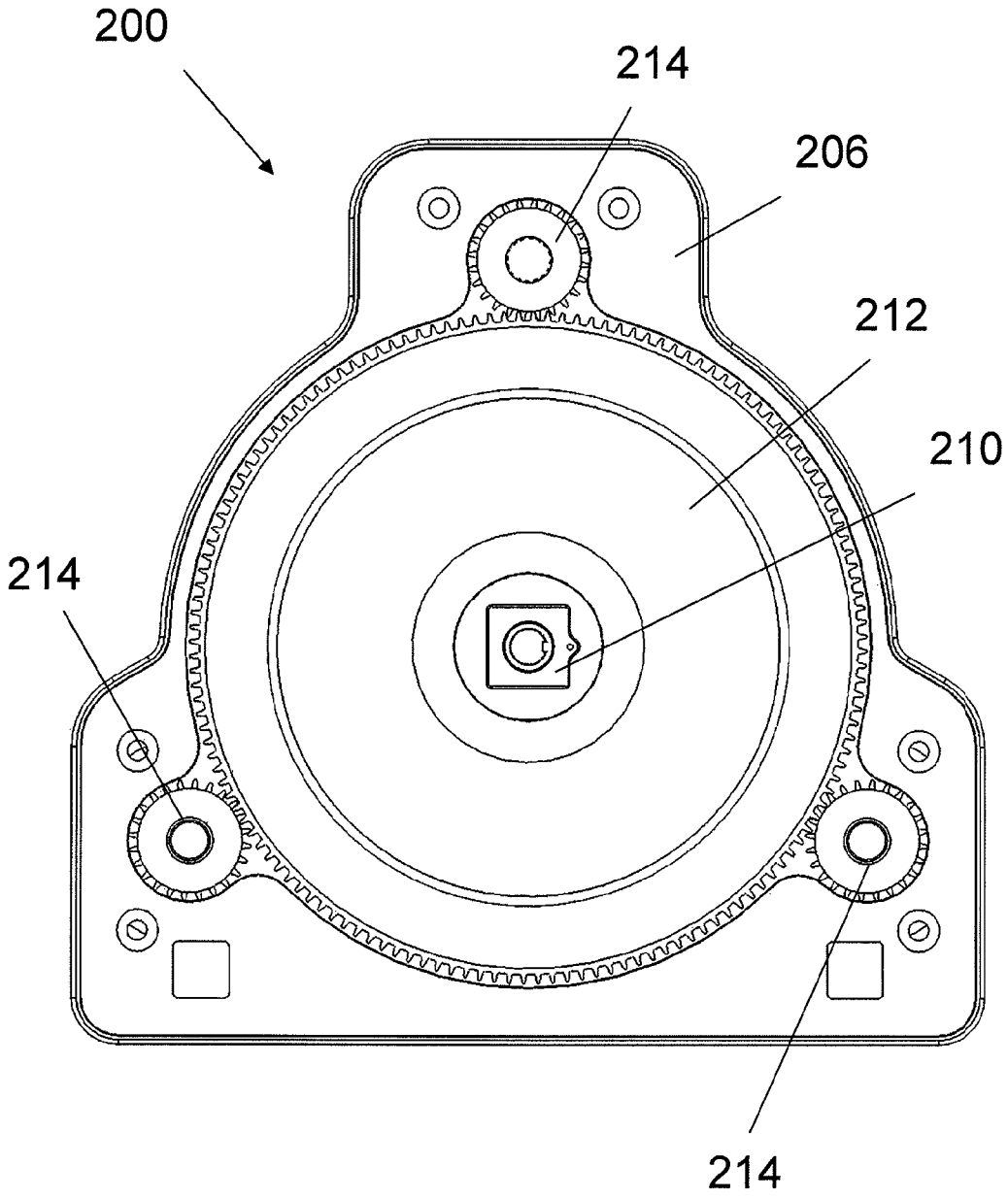
FIG. 20 is a front view of the embodiment of the present invention shown in FIG. 18.
Figure 21:
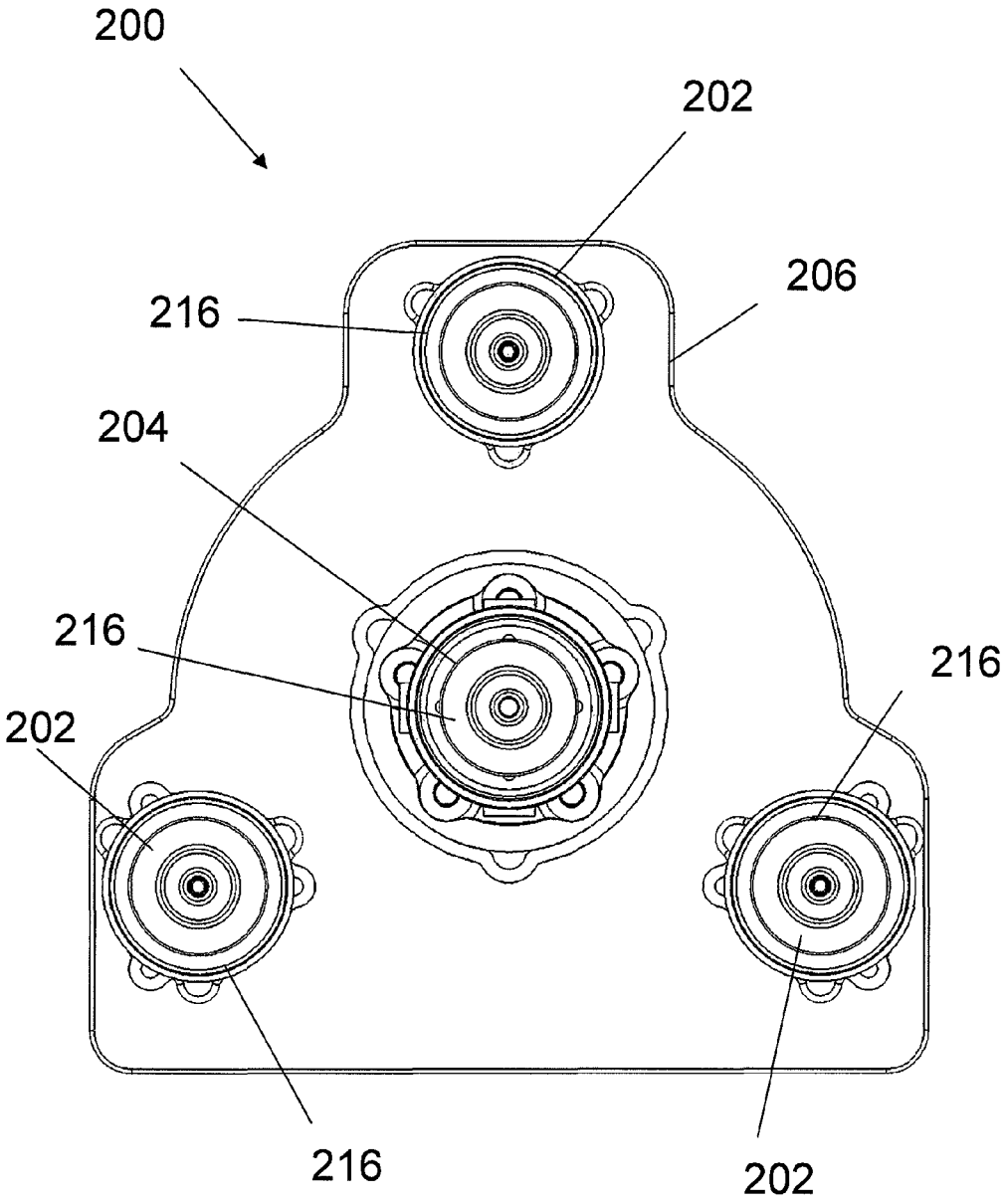
FIG. 21 is a rear view of the embodiment of the present invention shown in FIG. 14 without the drive belt engaged.
Figure 22:
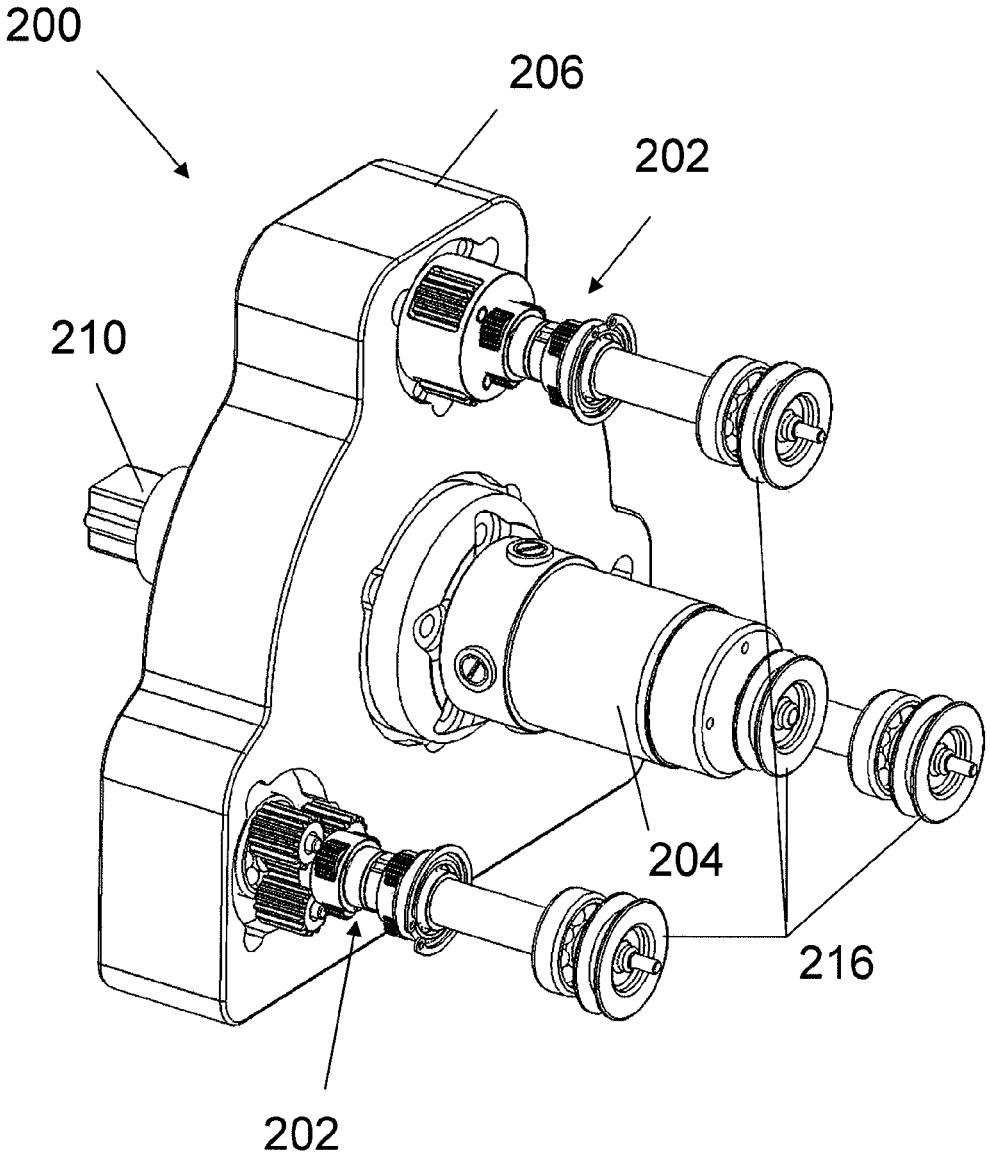
FIG. 22 is a perspective view of the embodiment of the present invention in FIG. 14 without the housing and cover of the multiple-stage stacked epicyclical geared transmissions.

FIGS. 16 and 17 illustrate the components of the one embodiment of the output disk and transmission drives including one centralized motor 527 engaged with drive three satellite transmissions 537, 538, 359 via a timing belt 535. One embodiment of the drive system includes pulley 501, drive shaft 502, cover 503, bearing 504, spacer 505, transmission housing with integral ring gear 506, "C" Clip 507, bearing 508, planetary cage with sun gear 509, bushing 510, stage 1 planet gear axles 511, stage 1 planet gear bearings 512, stage 1 planet gears 513, stage 2 planet gear axles 514, stage 2 planet gears 515, stage 2 planet gear bearings 516, stage 2 planet gear spider cage with sun gear 517, Third gear stage planet gear spider cage with splined output shaft 518, stage 3 planet gear axles 519, stage 3 planet gears 520, bearing 521, spur gear 522, output gear 523, work mounting king pin 524, stationary axle with flange 525, bearing 526, centrally mounted motor 527, coupling plate 528, sun gear 540, two speed torque multiplier 529, commercially available two speed torque adjustable clutch assembly 541, bearing 530, assembly enclosure 531, pulley 532, bearing 533, fasteners 534, timing belt 535, sun gear 536, multiple stage stacked transmissions 537, 538, 539, adjustable clutch assembly 541, center motor clutch planetary assembly 542, drive output shaft 543, and curved battery box 633 (see FIG. 33).

Motor 527 is coupled to a two speed torque multiplier 529 and adjustable clutch assembly 541 to drive output shaft 543 securely attached to pulley 532, and is supported for transverse and axial loads by bearing 530, 533 disposed between the drive output shaft 543 and the back mounting plate 544 (see FIG. 24) enabling supported direct drive to three equidistantly spaced apart multiple staged stacked transmissions 537, 538, 539 via a timing belt 535 or chain and sprockets for synchronous drive to an output gear 523.

As mentioned above, centrally mounted motor 527 and two speed torque multiplier 529 is rigidly mounted in drivable contact with three radially spaced apart multiple stage transmissions 537, 538, 539 via a drive belt 535. Each driven multiple staged transmissions 537, 538, 539 includes a three stage epicyclical gear stage 509, 517, 518 for progressive development of torque. The first stage of the three stage gear train is driven by a pulley 501, supported by a bearing 504 and keyed to a drive shaft 502 for shared engagement with center mounted output pulley 532 engaged with motor 527 and two speed torque multiplier 529. Pulley 501 drives the first stage of the planetary cage with sun gear 509 via drive belt 535 by rotating integrated drive shaft 502 and sun gear 509, and is maintained in drivable mesh with planet gears 513 supported for rotation in a planetary cage with sun gear 509 by axles 511 and bearings 512 (as an assembly comprises the first gear stage) is inserted into meshed engagement with ring gear disposed within the transmission housing 506 to multiple torque is aligned for complimentary engagement with the second gear stage of the three stage planetary multipliers by inserting sun gear 536 through an opening in end of stage 2 planet gear cage with sun gear 517 to mesh with planet gears 515 supported for rotation by axles 514 and bearings 516 is axially engaged into housing 506 and is responsive to rotary input from the first gear stage urging the assembly to travel in a circular path within the ring gear disposed within the transmission housing 506 to effect speed reduction and multiply torque.

Second gear stage sun gear 517 is inserted and is engaged into the inlet of Third gear stage comprised of third gear stage planet gear spider cage with splined output shaft 518 for operative meshed engagement with planet gears 520 supported for rotation by axles 519, responsive to torque input from the second gear stage to effect speed reduction and torque multiplication by urging the assembly to rotate within the internal ring gear at bottom end of housing 506 to drive the output shaft of Third gear stage planet gear spider cage with splined output shaft 518 supported by bearing 521 and secured for engagement with spur gear 522 in mesh with output gear 523 and further supported by bearing 526 that encircles axle 525 and work mounting king pin 524.

Three transmissions 537, 538, 539 of like description are spaced around the periphery of output gear 523 in drivable engagement with output gear 523 for reinforced staged torque multiplication of a plural synchronized power transmissions producing large torque values in a compact package.

One embodiment of the present invention has a gear reduction realized between the satellite gears 214 and the output gear 206 is 6:1 (144 teeth on output gear 206 and 24 teeth on satellite gears 214). The overall gear reduction of the single motor and three planetary transmissions is 6480:1, wherein the three stage planetary gears have a gear reduction ratio of 210:1 (first stage 6:1, second stage 6:1, and third stage 5:1) and a center motor and planetary with a clutch having a variable gear reduction ratio of 3 to 1 and 6:1. One embodiment of the single motor can be a 3 hp motor producing 10.26 ft-lb of torque.

Figure 23:
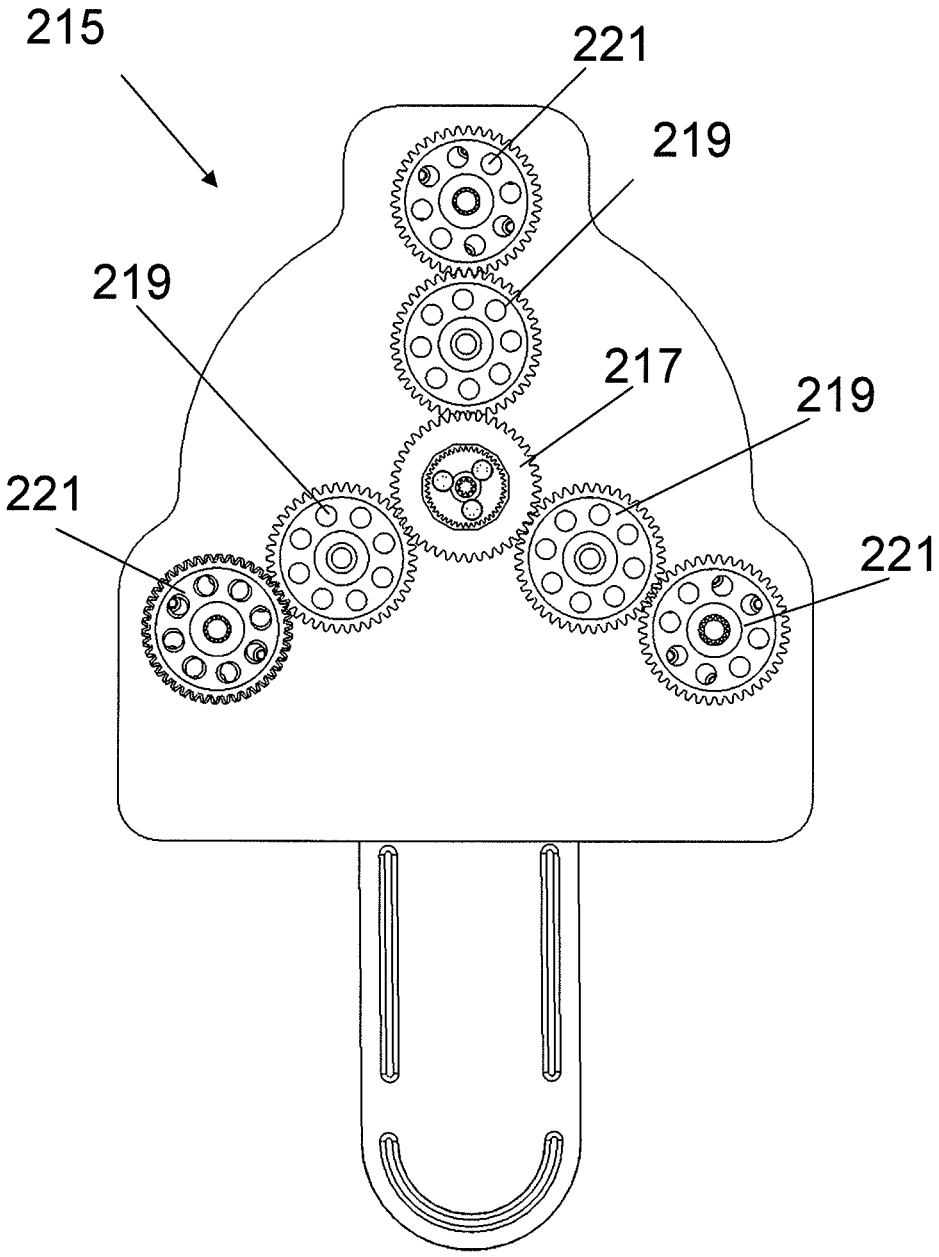
FIG. 23 is a rear view of another embodiment of the present invention showing a direct drive gear system replacing the belt driven transmission.

Now turning to FIG. 23 for an illustration of another embodiment 215 of the present invention showing a direct drive gear transmission replacing the belt driven system. Belt driven pulleys 216 and replaced with center motor gear 217 and planetary transmission gear 221 with intermediate gear 219 between center motor gear 217 and planetary transmission gear 221. An exemplary gear reduction ratio of the geared direct drive system is 3456:1 (6×6×4×4×6).

On embodiment of the plurality of transmissions 202 can include a multiple speed transmission and clutch. A strain gauge mounted in the reaction platform is used in conjunction with the center motor to select proper gear reduction in the plurality of transmissions responsive to reaction forces of tubing in contact with the platform during bending. A clutch is used as overload protection for the bender apparatus 200, so that introduction of material that cannot be bent will cause the clutch to overrun limiting torque to prevent breaking the bender apparatus 200. A back plate 218 ties all the transmissions 202 together and provides a surface to hold bearings that provide support to end shafts of transmission 202.

Tooth loading is what dictates a geared machines ability to transfer radial torque from a motors pinion gear to a driven output gear. As torque requirements increase common convention is to widen the gear tooth face width and lower the diametric pitch of the gear, (bigger gear tooth). And at the same time increase the strength of the material. This allows the gear tooth to withstand high shearing stress required by the work to be accomplished for instance tube, pipe and conduit bending.

The process of lowering the diametrical pitch and widening the gear tooth requires that the gear itself be enlarged in diameter to regain torque multiplication required to bend the heavy wall tubing. The single gear pair concept is further impaired by the fact that extremely high radial loads increase friction that must be over come with bigger heavy duty motors. Heavy-duty motors that require high voltage and moderate amperage. This forces contractors working on remote construction sites to provide and maintain mobile generators in order to bend tubing with large, heavy, expensive equipment.

One aspect of the present invention is to minimize radial loading on an output gear by distributing the large torque values required for bending to more than one gear tooth set by utilizing multiple gear tooth interface locations. By providing a plurality of synchronized planetary geared transmissions a central output gear can deliver balanced simultaneous torque input to multiple planetary stacked transmissions. This allows the tooth load to be divided by the number geared transmission provided allowing for use of finer pitched gear teeth, narrower gear teeth and smaller diameter output gears. At the same time stabilize the output gear against deflection loads imposed while bending heavy wall tubing. Individual torque loads required to rotate the output gear is reduced minimizing gear tooth friction. By reducing friction and increasing the individual interface sites enables the use of low voltage motors which are easily powered by rechargeable batteries. The net result is a battery operated bender that weighs less than 75 lbs that provides bending capabilities beyond the capabilities of a machine weighing over 500 lbs. requiring a 110 v power supply.

Figure 15:
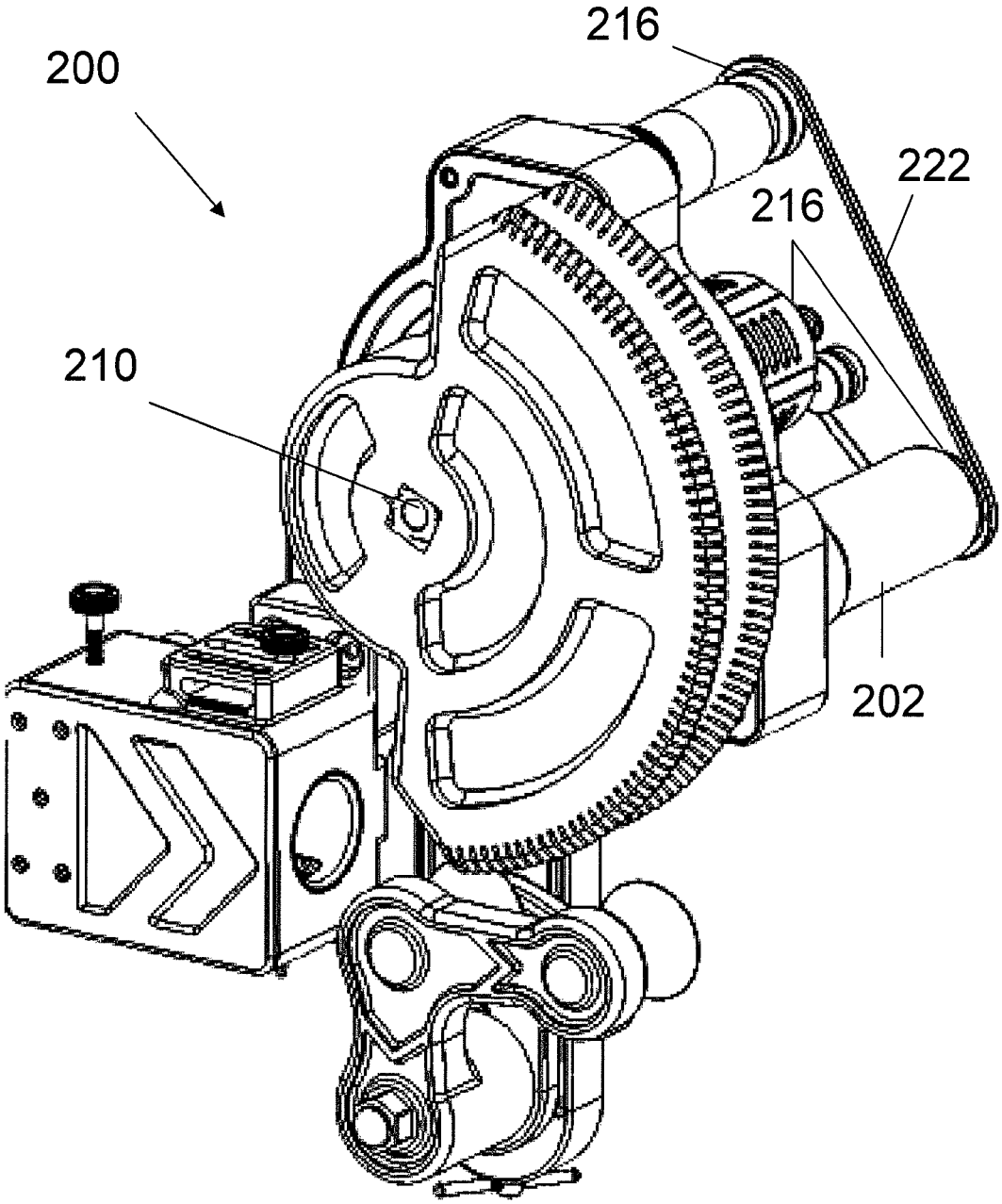
FIG. 15 is a front perspective view of another embodiment of the present invention shown in FIG. 14.
Figure 24:
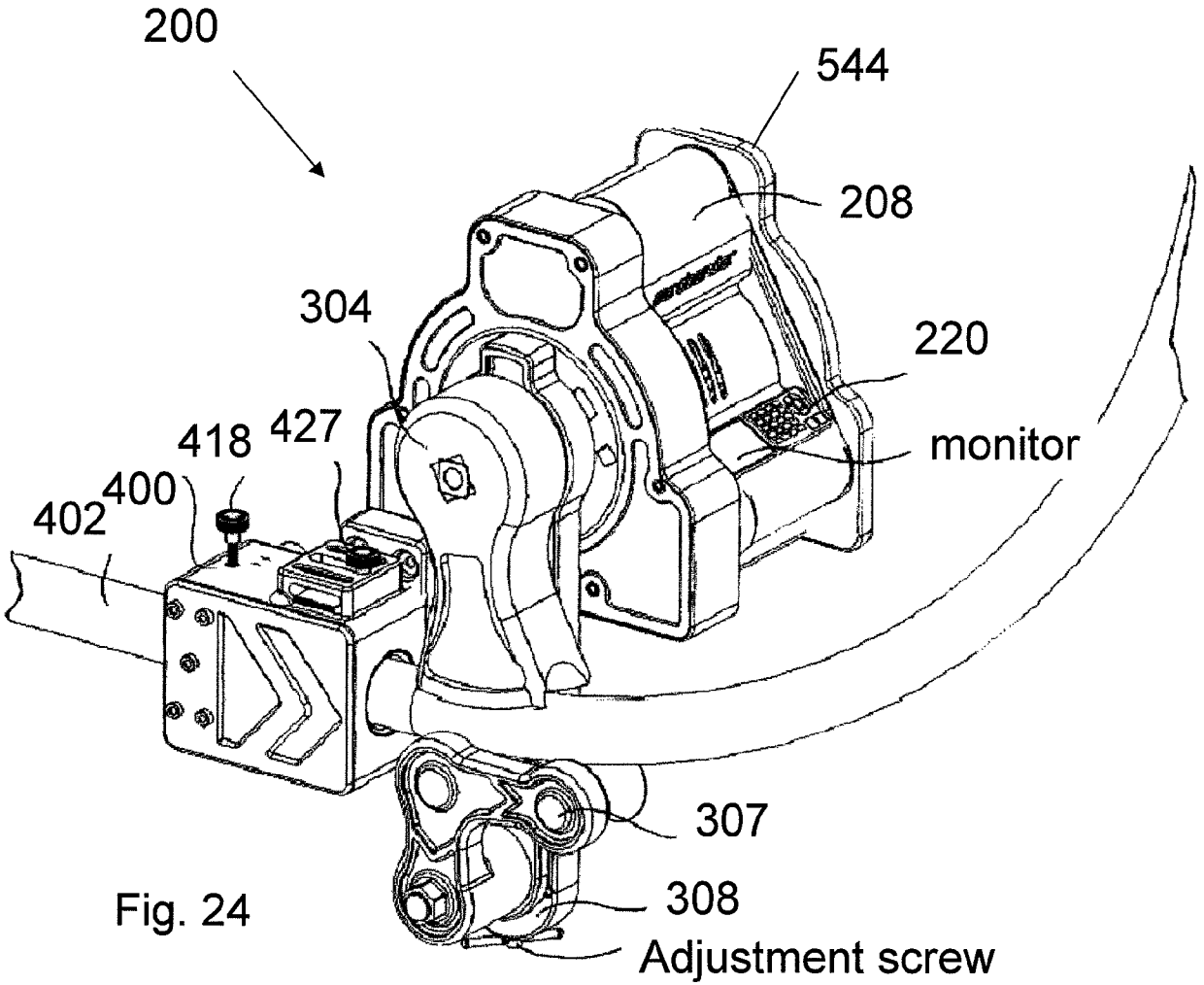
FIG. 24 is a front perspective view of an embodiment with its complete housing and back plate shown bending a tube with an alternative bending arm and a tubing incrementer.
Figure 25:
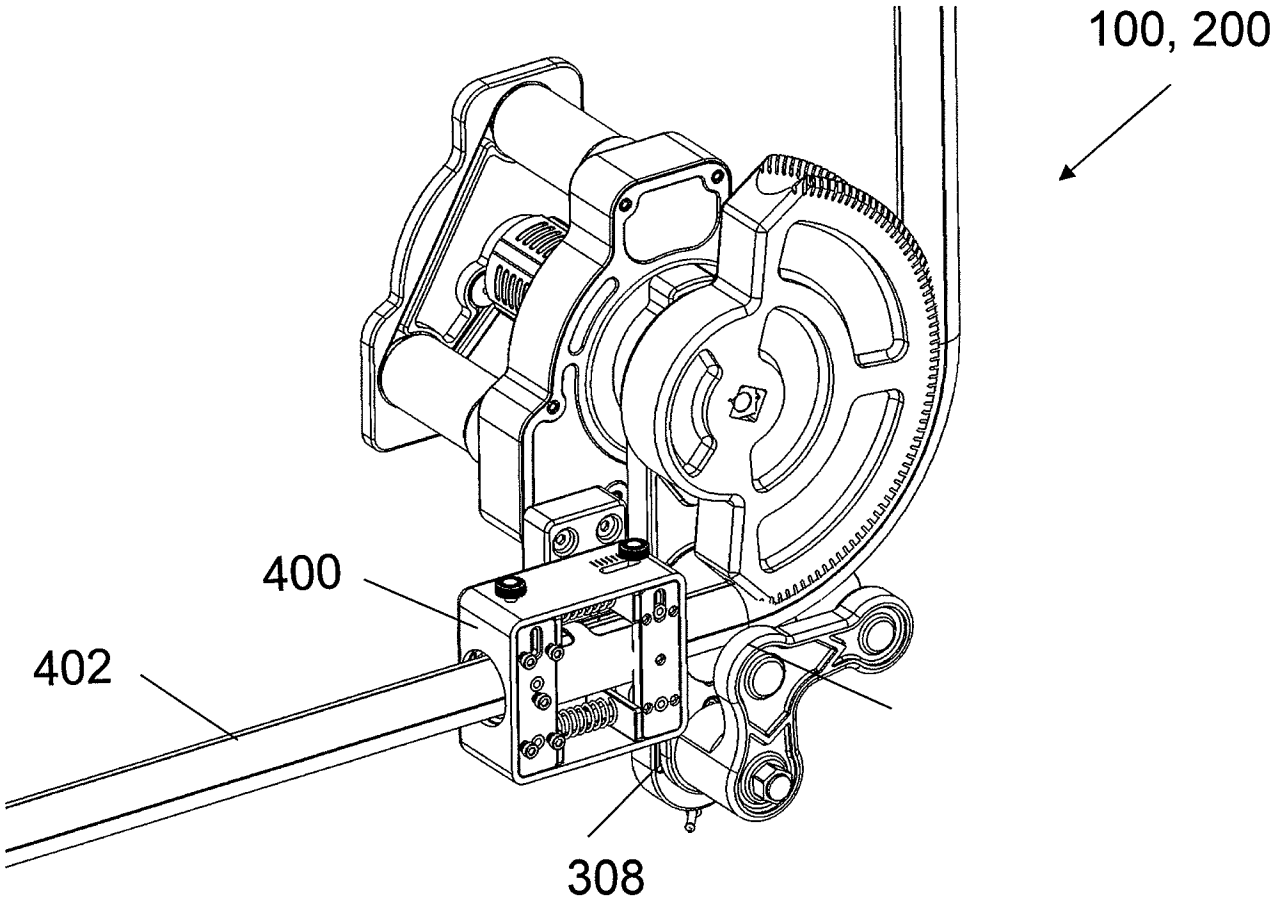
FIG. 25 is a front perspective view of the embodiment of FIG. 15 with its complete housing and back plate shown bending a tube with a tubing incrementer.
Figure 26:
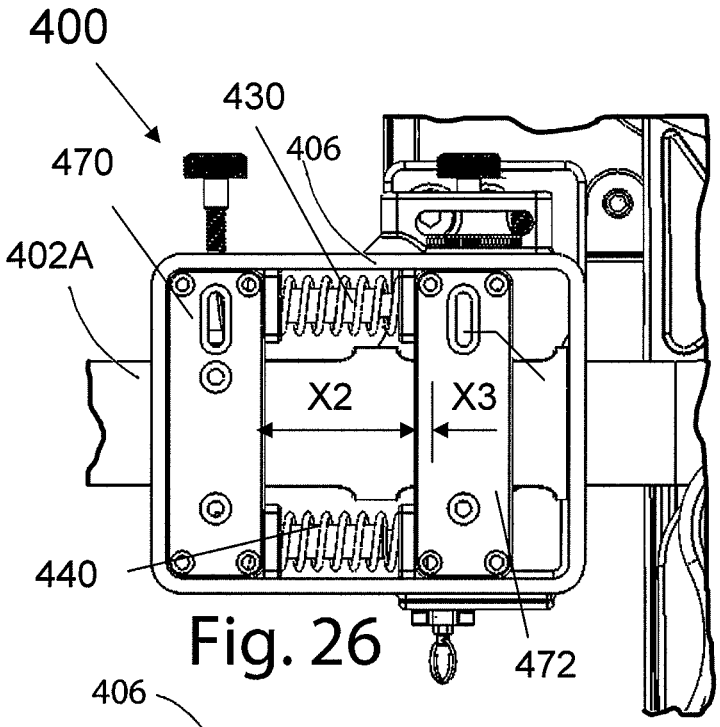
FIGS. 26 to 32 illustrate an incremental bending advancer attached to one embodiment of the present invention.
Figure 27:
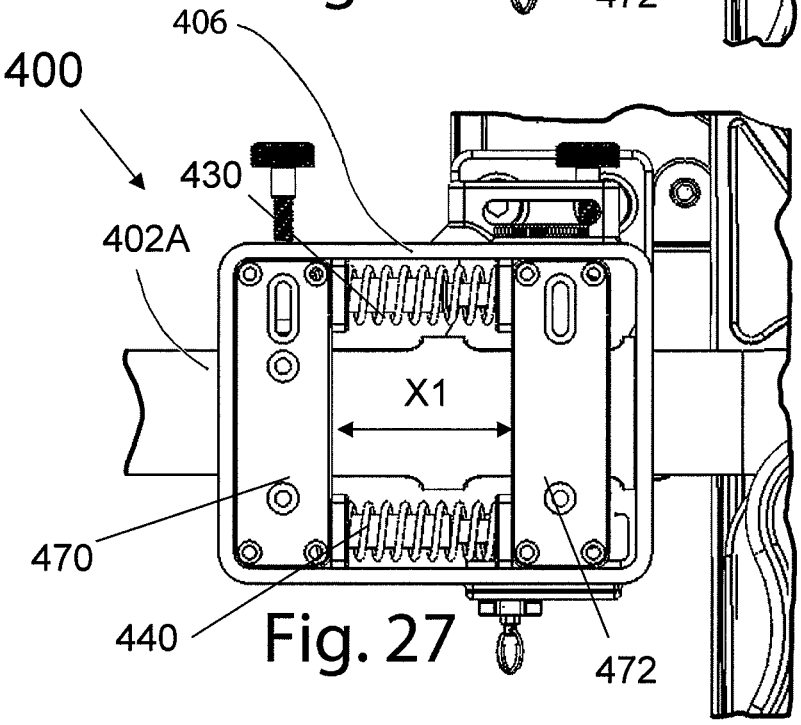
Figure 28:
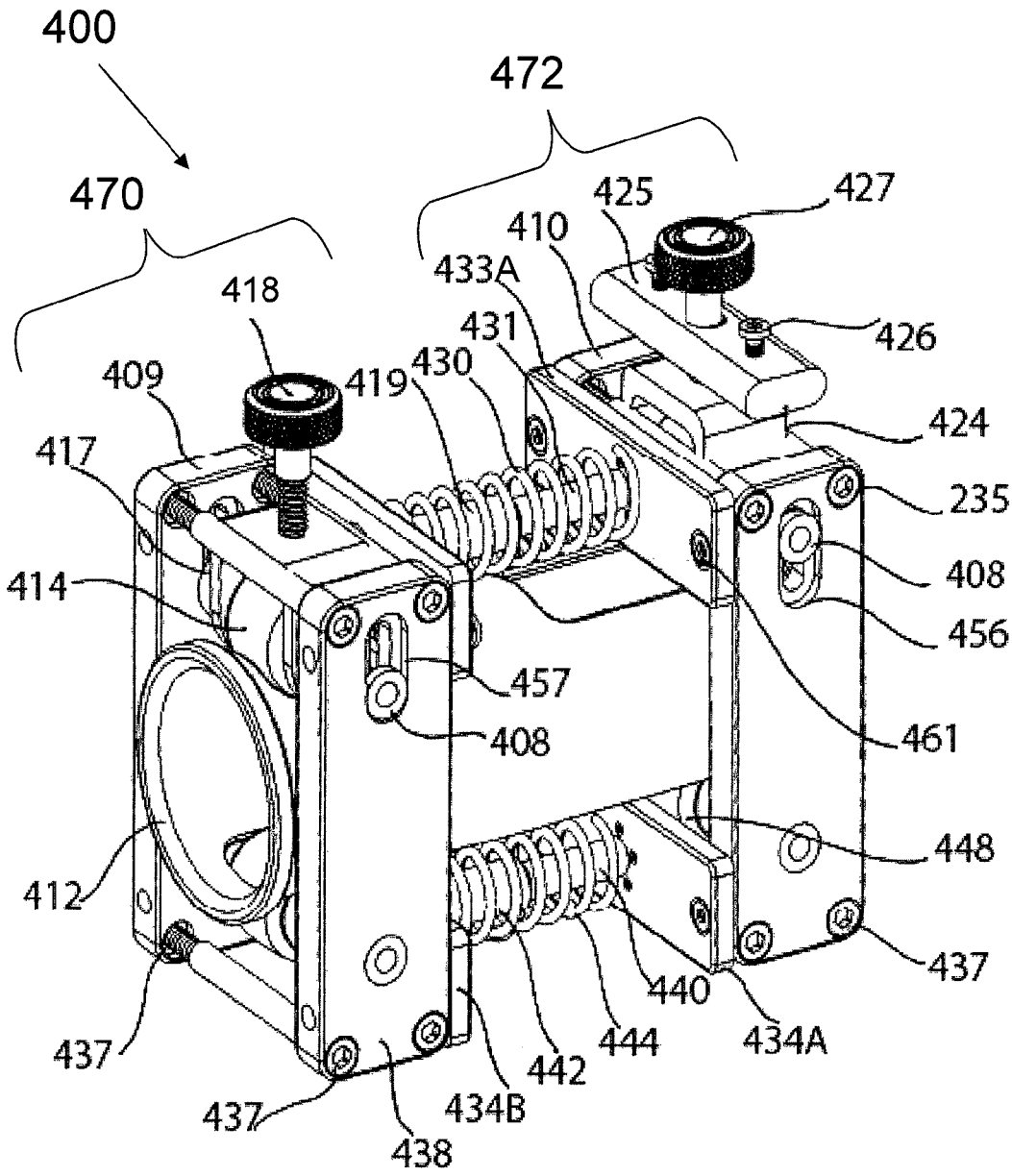
Figure 29:
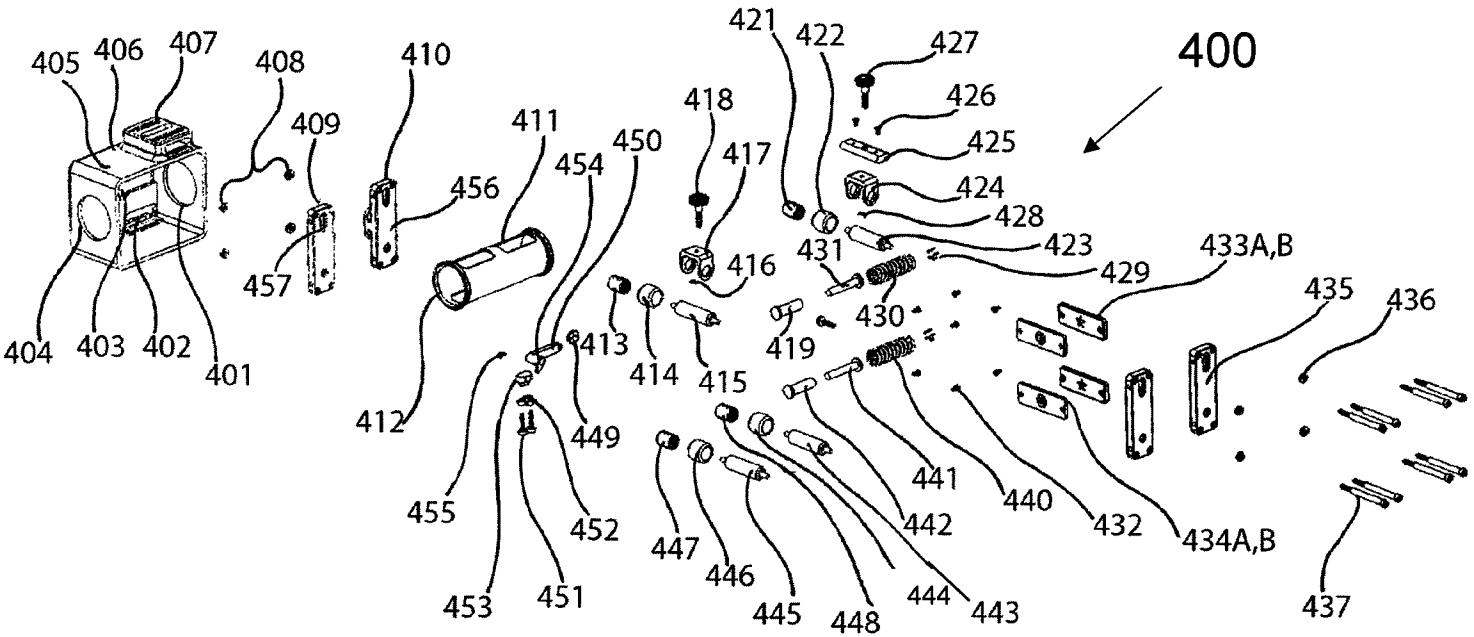
Figure 30:
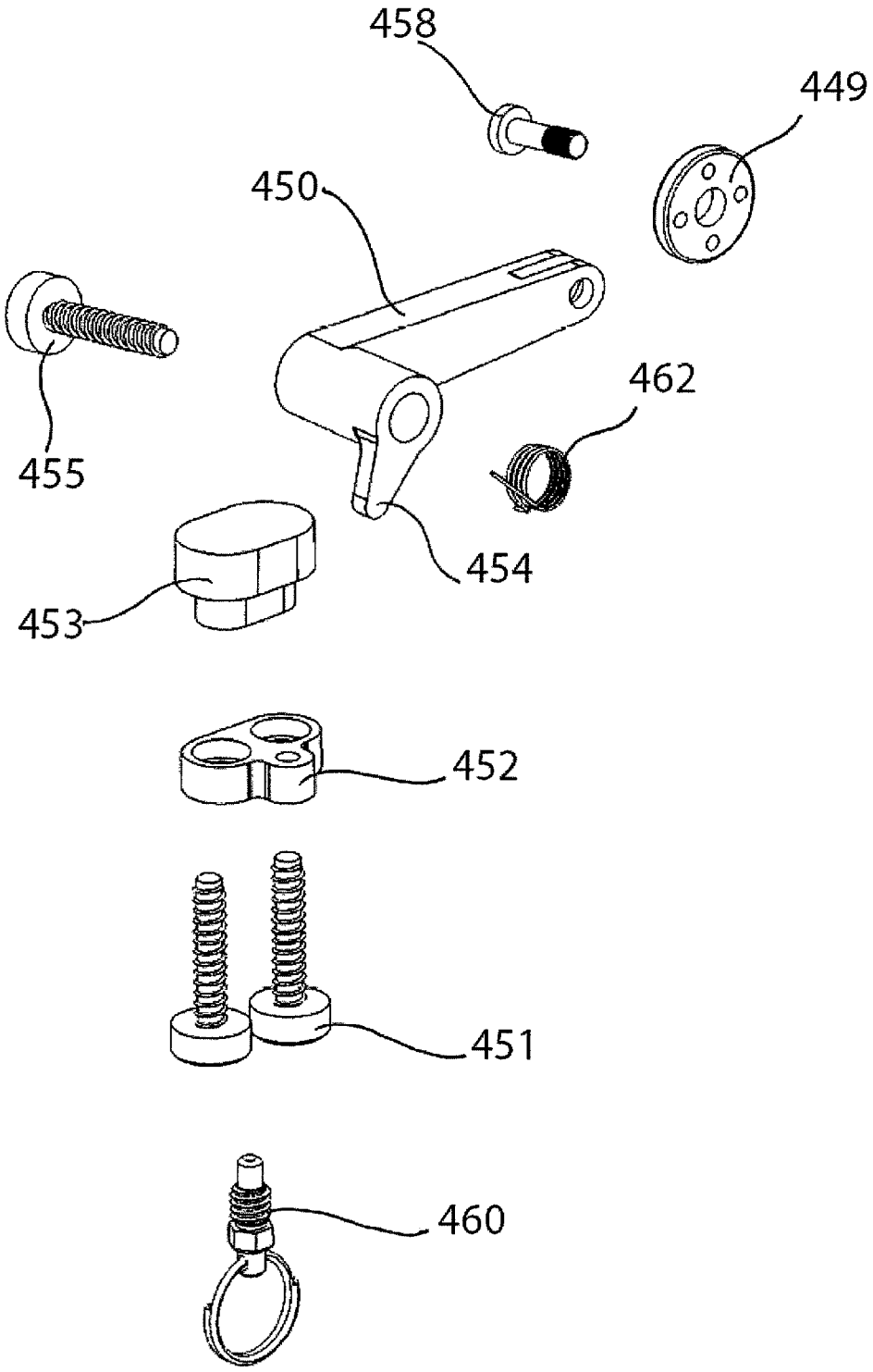
Figure 31:
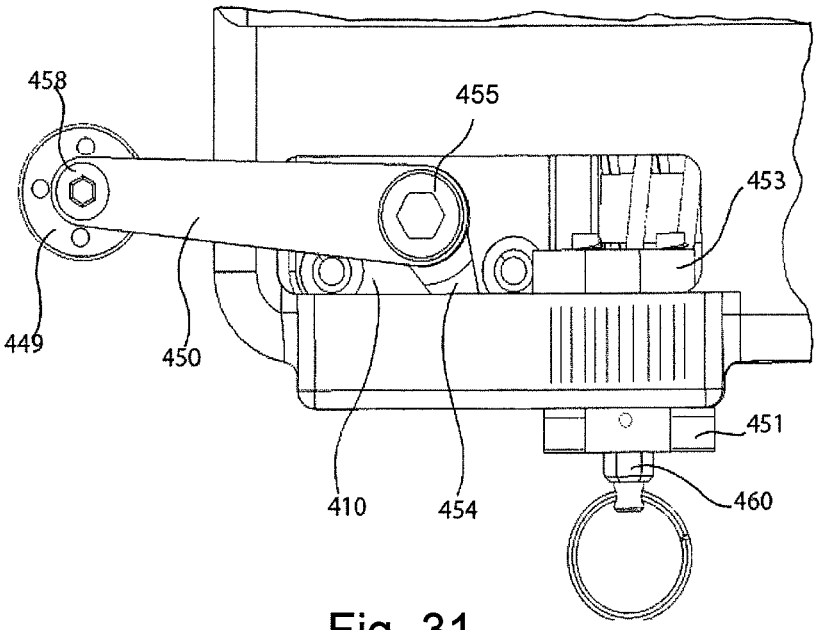
Figure 32:
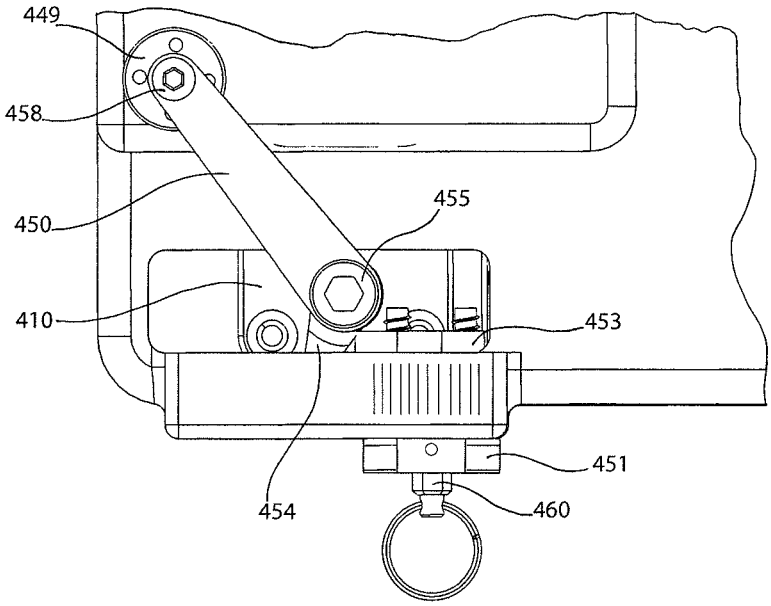

FIG. 24 is a front perspective view of the embodiment of FIG. 15 with its complete housing and back plate shown returning to home position after bending a tube.

FIGS. 25-31 illustrate an additional attachment of an mechanized incremental bending, where a tube advancement feeder 400 is utilized to advance tubing 402 to a position between the wheels 404 of the compression rollers of the bending apparatus 100, 200 in pre-measured increments in concert with preprogrammed incremental bend angle for the purpose of producing bend radius far in excess than the bend mandrel radius attached to the bending apparatus 100, 200. A look up table can be provided to correspond to a mandrel diameter that would allow the operator to establish how much tubing to feed into the bender and how far to bend the tubing for each advancement to achieve a desired bend radius. For example with the tube advancement feeder 400 set to a variable value of one inch, the bender arm 308 can be programmed to bend the tubing 402, for example, 2 degrees causing the bend radius to advance 2 degrees per inch upon a mandrel segment positioned at 6.0". The tube advancement feeder 400 is variable, for example between 0-3.0" and the bend angle is variable from 0-185 degrees. Mandrel size is selectable by the user of the tool and can be manufactured to any complementary radius required. This allows the bender apparatus 100, 200 to develop bent sections of tubing with a radius from just inches to many feet in diameter.

The tube advancement feeder 400 can include two sets of feed wheels fitted with ratchet clutches set in opposition to one and other separated by a set of spaced apart rails to enable rectilinear motion. One way roller clutch's and traction wheel sets are placed on two adjacent and separated platforms. Roller clutches on the first platform support clockwise rotation of the guide wheel set while the guide wheels and roller clutches allow for only counter clockwise rotation. The two side by side platforms are connected by bearing supported guide rails. Compression springs are used to bias the two platforms apart on from the other. A pneumatic piston is incorporated within one platform with the piston rod connected to the second platform. Actuation of the pneumatic piston pushes one platform away from the other such that when the first platform is secured to the bender tubing captured with the guide wheels of the first and second platform, is forced to move laterally upon each actuation of the device. A pneumatic actuator is positioned for contact by the wheel carriage arm of the bender at the conclusion of each subsequent bend made to the tubing. A valve contacting the drive arm and the end of each return cycle of the arm actuates a pneumatic piston to automatically advance the tube feeding mechanism. Pneumatic piston can be used to actuate a toggle to supply counter force to the reaction shoe. This sets up a succession of advancements and bends to generate an accurate shape of any desired radius greater than the bending mandrel provided to the bender.

Another embodiment of the present invention can include ports for multiple batteries to supply electrical power to the center mounted motor. The motor can be controlled at a central control panel with a switch. The apparatus's chassis can includes accessories mounting slots, for mounting ancillaries for bending, tube feeding, and cutting, and tube surfacing. The apparatus is configurable to accomplish multiple bending methods by changing the tube forming wheel from stationary to rotating by attaching accessories. The apparatus is adjustable for pipe holding pressure between the pipe rest and forming wheels to perfect the quality of the bends roundness during bending operations. The apparatus employs a double ratcheting pneumatic tube feeder for cooperation with the bending apparatus to enable incremental bends and stage intervals to develop acute radii in excess of the bending mandrel attached to the apparatus. The apparatus utilizes a stabilized output platform to drive a circular reel for tensioning and pulling cable through electrical conduit.

Attachments can expand the utility of the universal bender to include tube expanding and swaging, wire pulling, tube cutting and facing, and other tools to be a complete tubing manipulation solution. Square pocket receivers in the face of the tool receive and secure attachments.

One embodiment of the present invention includes a swing gate is provided with a slotted track to allow the gate to open and any point during the bending cycle without the use of tools. A pivoted lever is utilized on the end of the bender arm that is positioned to travel 3 to 5 degrees over center to clamp the form wheels firmly against the tubing and a traveling block for setting the form wheels to new positions. Mechanism is self locking by the action of bending a piece of tubing.

Further embodiments of the present invention include pressure wheels controlled through the bending program, power consumption monitoring used to verify tubing grade, and split shafts are useful for timing and synchronization issues.

Depending on tubing diameter and wall thickness combined with the material strength of the tubing the torque required to accomplish an accurate bend can be high and exceed 5 tons for 2.0" diameter tubing.

The present invention contemplates the use of a conventional on-board computer to calculate and regulate bend angle and is easily programmed to compensate for clockwise or counter clockwise bends and offset angles.

One embodiment of the present invention includes a drive gear to output gear delivering torque values ranging from, 9,408 foot pounds, to 28,224 foot pounds and cycle times ranging from 11 to 25 seconds.

One embodiment of the present invention includes a slide lock for rapid attachment of bending arm. Pivoting over center gate, locks tubing into wheels for tight fit. A further embodiment of the present invention includes a bending mandrel/reaction bar mount and a wire pulling attachment. An expanding mandrel for flaring tubing, and toggle actuated cutting attachment can also be provided.

A battery Cart (not shown) having slide couplings with electric contactors for and a slide receiving platform can be used to supply power of or recharge on-board batteries of an electric motor. Batteries are maintained within tool, wherein the transformer resides in cart. This allows the present invention to be removed from the cart and still able to run while detached from cart. The battery cart can include a slideable attachment head with conductive T slot elements for coupling bender to cart and communication of electrical current. The cart is configured with an onboard power supply, allowing the present invention to operate on 110 v AC while simultaneously recharging battery area integral with the present invention. A contact strip can be use to connect the present invention to a rolling cart to transfer power from carts batteries and transformer to the present invention.

One embodiment of the present invention includes bending mandrels with integrated reaction arm having a slot along a flat edge opposite the radius of the bender for attachment of a bender arm that is coplanar with the bending mandrel.

Another embodiment of the present invention includes a incremental advance mechanism 400 illustrated in FIGS. 26-32 that feeds tubing to the bender 100, 200 in specific measured lengths to the arcuate opening formed between the set of wheels stationed at the end of the bending arm and the attached forming wheel, to develop arc segments in excess of the radius of the mandrel installed on the bender. It is contemplated that the incremental advance mechanism 400 can have many embodiment and the illustrations contained herein are not meant to limit the claimed invention. One such embodiment includes: slide plate 425, slide plate housing 406, entry port 404, slide plate housing 407 adjustment screw for stationary roller set 418, adjustment screw for Bi-lateral slide mounted roller set 427, guide slot 403, bushings 408, back mounting support plate for stationary rollers 414 and 444, guide boss 410 (this is captured within the guide slot and travels left and right during operation), slot 457A-B (permits travel of the friction rollers up and down), back mounting support plate for bi-lateral roller set 456, arcuate rubber friction rollers 414, one directional roller clutch bearing assemblies 447, axles 445 (roller clutches and rubberized friction wheels), saddle bracket 417 (moveable up and down), saddle bracket 424 (moveable up and down), telescoping axle receiver 442, valve springs 430, 440 telescoping axle shaft 431, 441, stabilizer tube 412, attachment plates 433A, 433B for telescoping axles and receiver tubes (static set), attachment plates 434A, 434B for telescoping axles and receiver tubes (slide), forward mounting plates for each wheel holding assembly 435, 438, bushings 436, screws 437, exit hole for tubing 401, and fastener engagement points 462 (attaches incrementer to tool housing).

One example of an incremental advance mechanism 400 is comprised of two pairs vertically opposed griping wheel assemblies: static assembly 470, dynamic assembly 472. A first vertically opposed set of wheels 414, 446 are mounted between two horizontally opposed spaced apart plates 438, 409 to hold and support over and under axles 445, 415 with the top axle 415 disposed in a saddle bracket 417 allowing griping wheels 414, 446 to be tightened against tubing 402A (FIGS. 26 and 27) and lower wheel assembly lower axle 445 supporting rotation of unidirectional roller clutches 447 housed within gripping wheel 446 are secured by transverse lock plates 433A, 434A secure plates to form the entry wheel holding assembly 470.

A second vertically opposed set of wheels 422, 444 are mounted between two horizontally opposed spaced apart plates 410, 435 to hold and support over and under axles 423, 443 supporting for rotation unidirectional roller clutches 421, 413. Top axle 423 is mounted in a vertically moveable bracket 424 allowing griping wheel 422 to be tightened against tubing lower axle 443 supporting for rotation unidirectional roller clutch 448 housed with griping wheel 444. Axle ends are held in bushings 408, 436 secured within holes in second set of transverse lock plates 433B, 434B unify and secure plates, wheels, bracket and roller clutches forming dynamic assembly 472 providing two individual assemblies. Static assembly 470 is the entry roller assembly and remains stationary against rectilinear travel. Dynamic assembly 472 is supported for rectilinear travel on telescoping linear axles 431, 441 disposed within telescoping guide tubes 419, 442 spanning between static assembly 470 and dynamic assembly 472, each having telescoping pair of axles and telescope tubes encircled and biased apart one from the other by compression springs 430, 440 coupling together the assemblies. Dynamic assembly 472 includes a tube biasing bridge plate 425 that travels forward and aft while pushing against the inner top face of the bridge guide 407 providing a slideable biasing pressure allowing the gripping wheels 422, 444 to tighten against a piece of tubing 402A while supporting rectilinear movement each time a length of tube 402A is advanced through incrementer 400. Attached to the dynamic assembly 472 is pivoted wheel 449 attached to holding arm 450 being formed integral with an angularly disposed trigger blade 454 and is positioned so that contact with re-positional trigger block 453 forces the wheel 449 to pivot out of forcible biasing contact with bender arm upon contact with the trigger block 453. Wheel 449 is attached to dynamic assembly 472 by a threaded shoulder screw 458. Holding arm 450 is attached to dynamic assembly 472 by a threaded shoulder screw 455. Trigger block 453 is disposed in a guide track and slideably attached in adjuster slot 402 supplied with positioning holes corresponding to specific incremental values necessary for the development of predetermined arc segments by a spring biased retractable locking boss 460.

When assembled, the two spring biased assemblies 470, 472, pivoted wheel holding arm 450, and increment trigger block 453 are encircled and guided by a slotted tube 412 with each module positioned within separated slots 411 inserted into incrementer housing 406 secured into operative position with a set of screws 437.

As an assembled unit, the incrementer 400 is attached to the reaction base of bender 100, 200 with suitable fasteners.

To use incrementer 400 the operator of the bender sets a increment advance length by pulling down on spring loaded boss 460, slides the trigger block 453 to a position on the provided scale equal to the desired tube length to be advanced upon each stroke, and secures the block 453 by engaging the boss 468 into a receiving hole in adjuster slot 402. Spring biased wheel holding arm 450 is positioned for contact by tube bending arm such that the tube bending arm returning to the 6 0'clock home position at the conclusion of each bend increment pushes on the wheel 449 causing dynamic assembly 472 to compress the linear springs 430, 440 disposed on slideably engaged telescope rails 432 and 441 from an unloaded position X1 to a loaded position X2, thereby displacing linear springs 430, 440 by a predetermined distance X3 (X1−X2).

Static assembly 470 is positioned at the entry port includes vertically opposed gripping wheels disposed upon counter rotating roller clutches and allowing unidirectional movement of tubing from the entry port 404 towards the exit port 401 only. Dynamic assembly 472 includes vertically opposed gripping wheels disposed upon counter rotating roller clutches and axles allowing unidirectional movement of the tubing 402A from the static assembly 470 towards the dynamic assembly 472 and exit port 401.

Since dynamic assembly 472 is disposed for dynamic rectilinear travel, the unidirectional disposed roller clutches, gripping wheels and axles are free to rotate while dynamic assembly 472 moves towards static assembly 470 from right to left during the compression of the over and under springs 430, 440 (see FIG. 26), respectively, encircling the telescoping slide rails 431, 441. Friction created between the gripping wheels 422, 444 of dynamic assembly 472 hold the tubing 402A by compression one way roller clutches 421, 448 prohibit the slide block 453 from moving from right to left forcing dynamic assembly 472 to pull the tubing 402A through the housing body 406 of the incrementer 400 each time the pivoted arm 450 is pivoted out of engagement with the bending arm of the bender 100, 200 and the compressed springs 430, 440 return to an unloaded position (see FIG. 27).

A further description of mechanical incremental advancer 400 comprised of two front wheel side plates 409, 438 that hold sets of vertically opposed friction wheels 414, 446, one mounted above the other in each bracket set. The first vertically opposed set of wheels 414, 446 contains rubber contact rollers mounted for rotation upon one way roller clutches 413, 447 permitting the feeding of the tubing 402A in one direction (upper wheel 414 rotates only counter clockwise, lower wheel 444 rotates only clockwise). One way roller clutches 413, 447, which permit one way rotation, are mounted in a stationary bracket 417 on the left side of the advancer 400. This allows tubing to enter the advancer 400 in a first direction at the same time capturing the tubing. The second vertically opposed set of wheels 422, 444, each contain rubber contact rollers disposed upon one way roller clutches 421, 448, feeding tubing in one direction (upper wheel 422 rotates only counter clockwise, lower wheel 444 rotates only clockwise). Dynamic assembly 472 is permitted bi-lateral rectilinear motion within set limits. Dynamic assembly 472 is spring biased 430, 440 away from the stationary set of wheels 414, 446 at its lateral extent. Arm 450 with wheel 449 is pivotally mounted to dynamic assembly 472 and projects into the arcuate path of the bending arm such that contact of the wheel 449 with the bending arm returning to its home 6 o'clock position forces the bi-lateral moving dynamic assembly 472 to compress a set of valve springs 430, 440 during its return stroke.

Since the roller clutches 421, 448 are able to rotate in one direction (right) but not in the other direction (left), the only way for the loaded springs 430, 440 to return to an unloaded state (see FIG. 27) is to move the dynamic assembly 472 and the tubing it has captured within its rubber roller wheels 422, 444 thereby incrementally ejecting a pre-measured length of tubing.

The following illustrates an exemplary procedure of advancing a tube:

1. Movement of the tubing 402A from right to left occurs because the tubing 402A is captured by the friction rollers 414, 447 of static assembly 470.

2. Movement of the tubing 402A is provided by the potential energy stored within the valve springs 430, 440.

3. Potential energy is created by the compression of the valve springs 430, 440 provided by the driven torque arm power of the returning bending arm.

4. The tube 402A will not advance until the friction between the bending mandrel arm rollers and the tube is at minimum resistance. This occurs when the wheel on the bending arm are at approximately the 6 o'clock position.

5. Since the incremental advancer 400 is directly responsive to the returning bending arm, it is capable of advancing tubing 402A as quickly as the arm returns to the home position and is fully automatic and completely independent from the need for compressed air.

6. Adjustment screws 418, 427 are provided on both the static assembly 470 and the dynamic assembly 472 to enable the tension of the friction rollers 414, 422 to adjust for variations in tubing diameter.

7. A Site window is provided on the biasing frame 407 to verify linear travel is consistent with calculations required to bend specific tubing radius.

8. The advance travel is adjustable by pivoted arm 450 relative position to the bending arm.

For example, if it requires 5 pounds of force to pull the tubing through the incremental advancer 400, then the springs 430, 440 must receive in excess of 5 pounds of compression by the bending arm on the return cycle. Further the rubber friction wheels 414, 446, 422, 444 must provide in excess of 5 pounds of grip friction to pull the tubing 402A from within the advancer housing 406.

Another method to use the incremental advancer 400 is as follows:

a) align a length of tubing 402A with the entry port opening 404 pushing the tubing 402A beyond the entry compressive roller set 414, 446 through the lengthwise span of the housing 406 through the exit compressive roller set 422, 444 out the exit port 401;

b) pull the tubing 402A into the desired position with the contact rollers of the bending arm;

c) adjust the actuator tab 454 to the desired position from the bender arm that will result in the required advance increment; and d) cycling the bender will cause the incrementer 400 to advance the tubing 402A an equal distance upon the completion of each stroke until the tubing 402A is too short to be held by the forward roller set 414, 446.

Figure 33:
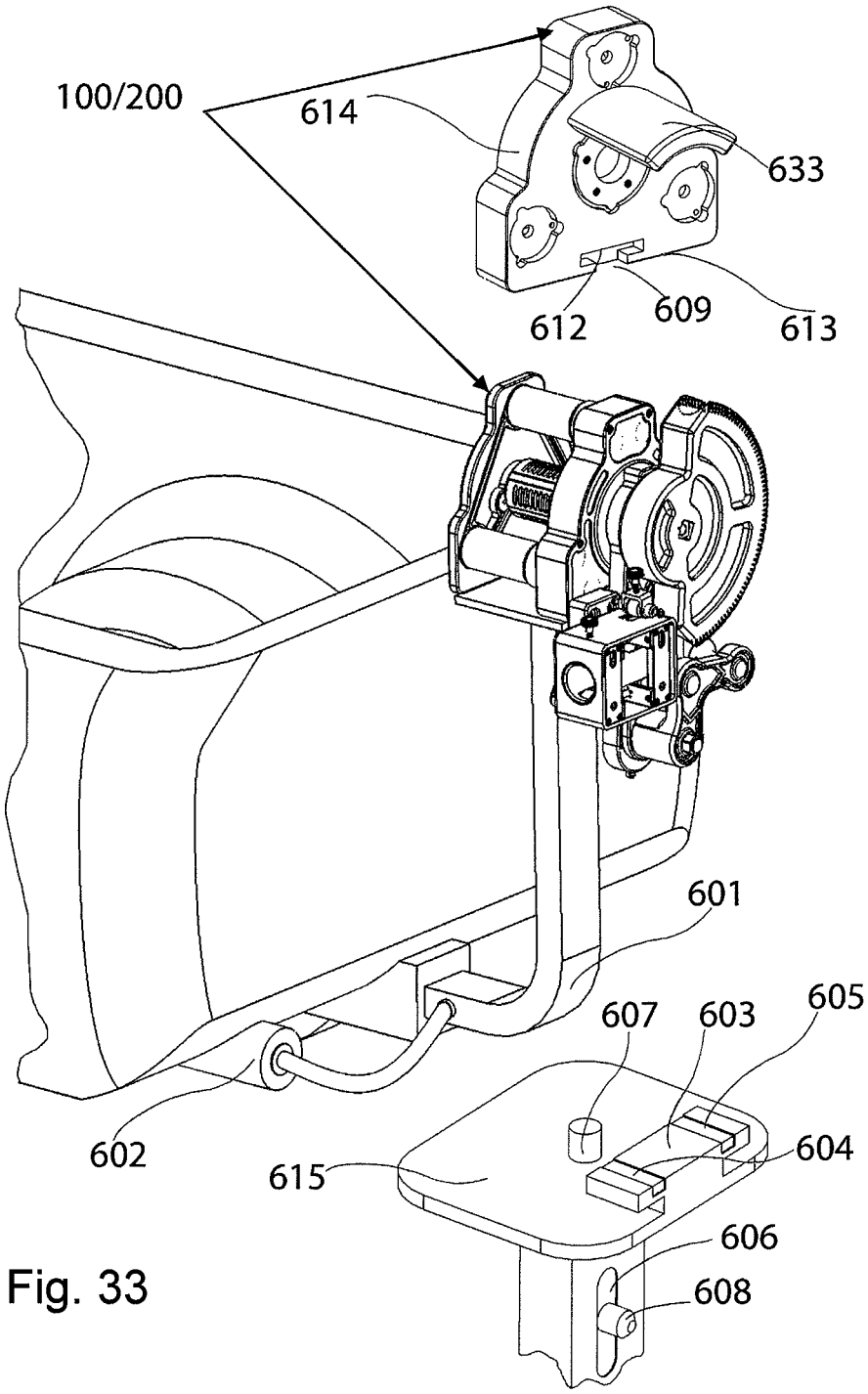
FIG. 33 is a perspective illustration of an attachment mechanism to a vehicle for transportation of the present invention from site to site.

Now turning to FIG. 33 illustrating a receiver hitch mount 600 to carry any embodiment 100, 200 of the present invention. Receiver hitch mount 600 includes a conductive interface platform 603 that transfers power from battery of the vehicle by way of the wired trailer break connection point 602 (e.g., trailer plug) to embodiment 100, 200. The bottom 613 of housing 614 is slotted 609 for engagement with negative contact strip 604 and positive contract strip 605 on top surface 615 of conductive interface platform 603. Conductive strips are attached to bottom surface 612 of slot 609 of embodiment 100, 200. A spring biased retractable pin 607 extending from the conductive interface platform 603 slides up and down to be received into hole (not shown) of embodiment 100, 200 to lock and unlock embodiment 100, 200 to receiver hitch mount 600. Bent tubing 601 of receiver hitch mount 600 is configured at one end to be received into a standard hitch and to retain conductive interface with platform 603 at the other end. Handle 608 in slot 606 of bent tube 601 is connected to retractable spring biased pin 607 for manual operation of pin 607.

While the disclosure has been described in detail and with reference to specific embodiments thereof, it will be apparent to one skilled in the art that various changes and modifications can be made therein without departing from the spirit and scope of the embodiments. Thus, it is intended that the present disclosure cover the modifications and variations of this disclosure provided they come within the scope of the appended claims and their equivalents.

What is claimed is:

1. A bending apparatus comprising:

a housing including a first chassis plate, and a second chassis plate;

at least one drive motor attached to the second chassis plate;

an output drive disk having (i) a geared outer circumference having a radius, and (ii) a center aperture, a plurality of synchronized motor transmissions operably connected to the at least one drive motor and operably connected to the front chassis plate, wherein each motor transmission of the plurality of synchronized motor transmissions includes an output drive disk idler gear engaged with the geared outer circumference of the output drive disk, wherein the output drive disk being disposed directly between the idler gears of the plurality of synchronized motor transmissions to structurally retain the output drive disk in a radial position about a common axis;

a first tool sized to be freely received through the center aperture of the output drive disk and attached to the housing and being cantilevered through the center aperture of the output drive disk such that the first tool does not contact the center aperture, wherein the first tool is stationary relative to the housing when the output drive disk rotates in an opposite direction than the idler gears of the plurality of synchronized motor transmissions; and a second tool attached to the outer drive disk and positioned adjacent to the first tool such that an article to be bent can be disposed between the second tool and the first tool while the output drive disk rotates.

2. The apparatus according to claim 1, wherein the output drive disk being capable of rotation about the common axis through the center aperture without a hub support engaged to the center aperture to radially support the output drive disk about the common axis.

3. The apparatus according to claim 1, wherein the at least one drive motor is a single drive motor being operably connected to the plurality of synchronized motor transmissions.

4. The apparatus according to claim 3, further comprising a single belt to operably connect the single drive motor to the plurality of synchronized motor transmissions.

5. The apparatus according to claim 3, further comprising an intermediate gear disposed between each motor transmission of the plurality of synchronized motor transmissions and the single drive motor to operably connect the single drive motor to the plurality of synchronized motor transmissions.

6. The apparatus according to claim 1, wherein the at least one drive motor is a plurality of drive motors, each drive motor being engaged with a motor transmission of the plurality of synchronized motor transmissions.

7. The apparatus according to claim 6, wherein each motor transmission of the plurality of synchronized motor transmissions comprises:

a shaft having an axis of rotation, wherein the axis of rotation of the shaft of each motor transmission is at a radial distance from the common axis that is less than the radius of the output drive disk;

a first idler gear connected to the shaft;

a second idler gear meshed with the first idler gear, wherein the second idler gear is connected to the output drive disk idler gear meshed with the outer circumference of the output drive disk;

whereby a torque is transmitted from the plurality of drive motors to the outer circumference of the output drive disk and a stacked diametral dimensions of the drive unit is minimized.

8. The apparatus according to claim 7, wherein the output drive disk is disposed between the second chassis plate and the front chassis plate and retained by the third idler gear without a hub support connected to the center aperture to align the output drive disk about the common axis.

9. The apparatus according to claim 1, wherein the output drive disk further comprises a front surface with an attachment feature to secure a second tool.

10. The apparatus according to claim 9, wherein the attachment feature are a plurality of holes sized to receive a plurality of extensions on a rear surface of the second tool such that the second tool rotates with the output drive disk while the first tool is stationary.

11. The apparatus according to claim 9, wherein the attachment feature to secure the second tool on the front surface of the output drive disk are a plurality of holes sized to receive a plurality of extensions on a rear surface of the second tool such that the second tool rotates with the output drive disk while the first tool is stationary.

12. The apparatus according to claim 1, further comprising a rectilinear article advancer to incremental advance the article for fractional bends relative to measured segments of the article.

13. The apparatus according to claim 12, wherein the rectilinear article advancer comprises:

a housing;

a static mount fixedly connected to the housing;

a bi-lateral slide mount moveably connected to the housing;

a pair of opposing one-directional axles connected to the static mount, wherein an upper axle rotates only in a counter-clockwise direction and a lower axle rotates only in a clockwise direction, wherein a roller is connected to each axle of the pair of opposing one-directional axles, wherein a gap is formed between the rollers;

a pair of opposing one-directional axles connected to the bi-lateral slide mount, wherein an upper axle rotates only in a counter clockwise direction and a lower axle rotates only in a counter-clockwise direction, wherein a roller is connected to each axle of the pair of opposing one-directional axles;

at least one biasing mechanism disposed between the static mount and the bi-lateral slide mount;

a tab connected to the bi-lateral slide mount positioned in a plane coincident with a path of the second tool, wherein the at least one biasing mechanism compresses to a predetermined displacement when the second tool contacts the tab to move the bi-lateral slide mount is displaced towards the static mount on a return cycle of the second tool;

wherein the rollers connected to the static mount retain a tube disposed there between and inhibit lateral movement when the bi-lateral slide mount towards the static mount;

wherein the rollers connected to the bi-lateral slide mount retain the tube disposed there between and laterally move the tube relative to the bi-lateral slide mount when the bi-lateral slide mount moves away for the static mount when the at least one biasing mechanism expands to a predetermined lateral distance;

whereby the tube advances a lateral distance equivalent to the predetermined lateral distance of the expanded at least one biasing mechanism.

14. The apparatus according to claim 1, further comprising a bi-directional control unit connected to the drive motor for clockwise and counter clockwise operation of the drive motor.

15. The apparatus according to claim 1, wherein the first tool includes an elongated shaft with a back plate attached to a back chassis plate and the elongated shaft extends out beyond a front face of the output drive disk to connect a third tool.

16. The apparatus according to claim 15, wherein the front chassis plate comprises (i) a center opening to externally expose the front surface of the output drive disk and (ii) a front face with two apertures to receive an extension of an article holder, wherein an object holder and the third tool cooperate to retain the article while the second tool rotates during an operation on the article.

17. The apparatus according to claim 16, wherein the third tool is a forming die and the article is a tube.

18. The apparatus according to claim 16, wherein the third tool is a cutting tool and the article is a tube.

* * * * *